US008036778B2

(12) United States Patent
Masuda et al.

(10) Patent No.: US 8,036,778 B2
(45) Date of Patent: Oct. 11, 2011

(54) AIR-CONDITIONING SYSTEM

(75) Inventors: Yoshiyuki Masuda, Kusatsu (JP); Atsushi Nishino, Kusatsu (JP); Satoshi Hashimoto, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 283 days.

(21) Appl. No.: 12/522,946

(22) PCT Filed: Jan. 16, 2008

(86) PCT No.: PCT/JP2008/050404

§ 371 (c)(1),
(2), (4) Date: Jul. 13, 2009

(87) PCT Pub. No.: WO2008/087959

PCT Pub. Date: Jul. 24, 2008

(65) Prior Publication Data

US 2010/0036533 A1 Feb. 11, 2010

(30) Foreign Application Priority Data

Jan. 17, 2007 (JP) ..... 2007-008565
Mar. 23, 2007 (JP) ..... 2007-077152

(51) Int. Cl.

| | |
|---|---|
| ***G05B 21/00*** | (2006.01) |
| ***G05B 13/00*** | (2006.01) |
| ***G05B 15/00*** | (2006.01) |
| ***G01M 1/38*** | (2006.01) |
| ***G05D 23/00*** | (2006.01) |
| ***G05D 23/275*** | (2006.01) |
| ***F24F 3/00*** | (2006.01) |
| ***F24F 11/00*** | (2006.01) |
| ***F24F 7/00*** | (2006.01) |
| ***F24F 13/06*** | (2006.01) |
| ***F25B 29/00*** | (2006.01) |
| ***F24D 19/10*** | (2006.01) |
| *F24F 13/08* | (2006.01) |
| *F24F 13/14* | (2006.01) |

(52) U.S. Cl. ..... 700/277; 700/278; 165/208; 165/212; 165/237; 165/253; 236/1 B; 236/49.1; 454/258; 454/325; 454/335

(58) Field of Classification Search ..... 700/275–278; 236/1 B, 49.1, 49.3–49.5, 91; 454/256, 258, 454/284, 322, 325, 333, 335, 369, 370; 165/200, 165/201, 205, 208, 211, 212, 222, 223, 237, 165/253

See application file for complete search history.

(56) References Cited

U.S. PATENT DOCUMENTS 5,058,388 A * 10/1991 Shaw et al. ..... 62/93

(Continued)

FOREIGN PATENT DOCUMENTS

CN 2215091 Y 12/1995

(Continued)

OTHER PUBLICATIONS

Hamdi et al., "A fuzzy control system based on the human sensation of thermal comfort", Fuzzy Systems Proceedings, IEEE World Congress on Computational Intelligence, vol. 1, Publication Year: 1998, pp. 487-492.*

(Continued)

*Primary Examiner* — Crystal J Barnes-Bullock
(74) *Attorney, Agent, or Firm* — Global IP Counselors

(57) ABSTRACT

An air-conditioning system includes an air-conditioning unit that is switchable between local air-conditioning and overall air-conditioning, a data acquisition unit configured to acquire state quantity data of a requester, and a control unit. The control unit calculates comfort assessment values for both the requester and a neighbor, and controls the air-conditioning unit so that the local air-conditioning is performed to an extent whereby the comfort assessment value of the neighbor is kept in a comfort range and the comfort assessment value of the requester can be within the comfort range.

14 Claims, 24 Drawing Sheets

U.S. PATENT DOCUMENTS

| | | | | |
|---|---|---|---|---|
| 6,430,953 | B2 * | 8/2002 | Roh | 62/231 |
| 6,983,889 | B2 * | 1/2006 | Alles | 236/49.1 |
| 7,177,776 | B2 * | 2/2007 | Whitehead | 702/118 |
| 7,343,226 | B2 * | 3/2008 | Ehlers et al. | 700/276 |
| 7,455,237 | B2 * | 11/2008 | Kates | 236/1 B |
| 7,516,622 | B2 * | 4/2009 | Gauthier et al. | 62/157 |
| 2004/0067731 | A1 * | 4/2004 | Brinkerhoff et al. | 454/325 |
| 2004/0079094 | A1 | 4/2004 | Kasai et al. | |
| 2007/0083294 | A1 * | 4/2007 | Bruno | 700/295 |
| 2007/0178823 | A1 * | 8/2007 | Aronstam et al. | 454/256 |
| 2009/0281667 | A1 * | 11/2009 | Masui et al. | 700/276 |
| 2011/0034120 | A1 * | 2/2011 | Jaiyeola | 454/335 |

FOREIGN PATENT DOCUMENTS

| | | | |
|---|---|---|---|
| CN | 1514923 | A | 7/2004 |
| JP | 63-099449 | A | 4/1988 |
| JP | 02133741 | A * | 5/1990 |
| JP | 04-116328 | A | 4/1992 |
| JP | 08-159534 | A | 6/1996 |
| JP | 10-300172 | A | 11/1998 |
| JP | 2005-295160 | A | 10/2005 |
| JP | 2006-349240 | A | 12/2006 |
| KR | 1991-0005004 | | 3/1991 |
| KR | 2005-0106185 | | 11/2005 |

OTHER PUBLICATIONS

Federspiel et al., "User-Adaptable Comfort Control for HVAC Systems", American Control Conference, Publication Year: 1992, pp. 2312-2319.*

Chinese Office Action of corresponding Chinese Patent Application No. 200880002454.5 dated Dec. 17, 2010.

Chinese Office Action of corresponding Korean Patent Application No. 10-2009-7015497 dated May 16, 2011.

* cited by examiner

FIG. 9

$$PMV = f\left(\begin{array}{c}\text{AIRFLOW TEMPERATURE, AIRFLOW RATE, RELATIVE HUMIDITY,}\\ \text{RADIATION TEMPERATURE, AMOUNT OF CLOTHING, METABOLISM RATE}\end{array}\right) = 0.44$$

| | CALCULATION METHOD (APPROACH) | CALCULATION RESULT |
|---|---|---|
| AIRFLOW TEMPERATURE | CALCULATED THROUGH CHARACTERISTIC FORMULA | 24.1°C |
| AIRFLOW RATE | CALCULATED THROUGH CHARACTERISTIC FORMULA | 2.5m/s |
| RELATIVE HUMIDITY | CALCULATED FROM ABSOLUTE HUMIDITY AND AIRFLOW TEMPERATURE, ASSUMING ABSOLUTE HUMIDITY IS SUBSTANTIALLY THE SAME IN DISTANCE R AND IN VICINITY OF DISCHARGE PORT (RELATIVE HUMIDITY 90%) | 62% |
| RADIATION TEMPERATURE | RADIATION TEMPERATURE ≈ ROOM TEMPERATURE ≈ SUCTION TEMPERATURE | 27°C |
| AMOUNT OF CLOTHING | AVERAGE AMOUNT OF AMOUNT OF CLOTHING IN OFFICE DURING SUMMER ( = LIGHT SUMMER CLOTHES) | 0.6clo |
| METABOLISM RATE | CALCULATED FROM HUMAN BODY MODEL | 2.0met |

HYPOTHETICAL CONDITIONS

| | |
|---|---|
| DISCHARGE PORT CONSTANT | 3.9 |
| DISCHARGE PORT EFFECTIVE WIDTH | 0.05m |
| RADIAL-FLOW DISCHARGE PORT DIAMETER | 0.4m |
| DISTANCE | 0.6m |
| ELAPSED TIME | 10 MIN |

| | |
|---|---|
| DISCHARGE AIRFLOW RATE | 7.2m/s |
| ANGLE FORMED BY DISCHARGE DIRECTION AND CEILING SURFACE | 65° |
| DISCHARGE TEMPERATURE | 18°C |
| SUCTION TEMPERATURE | 27°C |

$$\frac{\Delta t_R}{\Delta t_0} = \sqrt{\frac{0.83K(H_0/R_0)\cos\theta\{K(H_0/R_0)\cos\theta+1\}}{(R/R_0)\{(R/R_0)\square 1\}}}$$

$$\frac{V_R}{V_0} = \sqrt{\frac{K(H_0/R_0)\cos\theta\{K(H_0/R_0)\cos\theta+1\}}{(R/R_0)\{(R/R_0)\square 1\}}}$$

AIR-CONDITIONING SYSTEM

CROSS-REFERENCE TO RELATED APPLICATIONS

This U.S. National stage application claims priority under 35 U.S.C. §119(a) to Japanese Patent Application No. 2007-008565, filed in Japan on Jan. 17, 2007, and Japanese Patent Application No. 2007-077152, filed in Japan on Mar. 23, 2007, the entire contents of which are hereby incorporated herein by reference.

TECHNICAL FIELD

The present invention relates to an air-conditioning control system for supplying conditioned air to a plurality of users in a target space.

BACKGROUND ART

In conventional practice, there have been used air-conditioning systems that use timer settings and other techniques so as to provide a specific comfortable air-conditioned environment for users returning after being outdoors. For example, a user return time is set in advance, a pre-cooling operation is performed in which the temperature is set from a predetermined time before the user return time to a temperature between the target setting temperature and the outdoor temperature, and an operation is performed for setting the temperature to the target setting temperature at the time the user returns. It is thereby possible to provide a specific comfortable atmosphere for the returning user, and to prevent the user from being discomforted when exposed to the temperature difference and allow the user to become gradually accustomed to the indoor environment.

With the air-conditioning system described in Japanese Patent Application Laid-open Publication No. 4-116328, for example, the amount of clothing worn by the user or the activity amount of the user before returning is inputted as data for air-conditioning control, and a comfortable space for the user can be quickly provided with this data taken into account.

SUMMARY OF THE INVENTION

Technical Problem

However, with the air-conditioning system described in Japanese Patent Application Laid-open Publication No. 4-116328, providing a comfortable space assumes a case in which only one user is located in said space, and no consideration is given to providing comfort for respective people in a case in which a plurality of users are located in the same space.

Particularly, there has been no development of techniques whereby the comfort of respective users is improved with respect to the users located adjacent to each other in the same space.

The present invention was devised in view of the above circumstances, and an object thereof is to provide an air-conditioning system whereby adjacent users do not impede each others' comfort, and the comfort of the requesters can be improved.

Solution to Problem

An air-conditioning system according to a first aspect of the present invention is an air-conditioning system for supplying conditioned air to a plurality of users located in a target space, the air-conditioning system comprising an air-conditioning unit, a state quantity data acquisition unit, and a control unit. The air-conditioning unit is capable of switching between local air-conditioning for directing airflows into part of the target space and overall air-conditioning for directing airflows throughout the entire target space. The state quantity data acquisition unit acquires state quantity data of a requester moving in or into the target space. State quantities herein include, e.g., met values or the like which differ according to movement amount, activity amount, and other factors. The control unit calculates comfort assessment values for assessing a predetermined range as being comfortable to the requester and a neighbor on the basis of at least the data acquired by the state quantity data acquisition unit and the operating state of the air-conditioning unit. The control unit also performs a control such that the local air-conditioning for the requester is performed to an extent whereby the comfort assessment value of the neighbor is maintained in the predetermined range and the comfort assessment value of the requester is within the predetermined range.

In the first aspect of the invention, the comfort of the requester can be quickly improved by performing local air-conditioning for the requester. Moreover, the local air-conditioning is controlled such that the comfort assessment value of the neighbor is maintained in the predetermined range.

It is thereby possible to minimize hindrances to the comfort of the neighbor while improving the comfort of the requester through local air-conditioning.

An air-conditioning system according to a second aspect of the present invention is the air-conditioning system of the first aspect of the present invention, wherein the control unit performs control for derating the level of local air-conditioning in cases in which the comfort assessment value of the requester has reached the predetermined range.

When the comfort assessment value of the requester has reached the predetermined range and a comfortable environment for the requester has been successfully provided, the comfort of the requester is not likely hindered even if the level of local air-conditioning is reduced, because there is no need to continue to perform the previous local air-conditioning.

It is thereby possible to conserve energy by reducing local air-conditioning.

An air-conditioning system according to a third aspect of the present invention is the air-conditioning system of the first or second aspect of the present invention, wherein the state quantity data acquisition unit has a mobile communication terminal and any one of at least a GPS, a mobile communication terminal, a wireless LAN base station and a ubiquitous sensor network, any of which are for acquiring position data until the requester moves into the target space. The mobile communication terminal is used while being carried by the requester, whether a GPS, wireless LAN base station, or ubiquitous sensor network is used. The mobile communication terminal herein includes, e.g., a GPS portable phone or a PHS when used with a GPS, a mobile communication terminal having a wireless LAN function when used with a wireless LAN base station, a terminal used in a ubiquitous sensor network, and the like.

In the third aspect of the invention, the state quantity data acquisition unit is capable of acquiring records of the users' position data through wireless communication with the mobile communication terminal carried by the user. It is thereby possible to perceive the user's state of movement.

It is thereby possible to adjust the level of local air-conditioning to an extent suited to the state of the requester by estimating the metabolism rate of the requester from the movement record.

An air-conditioning system according to a fourth aspect of the present invention is the air-conditioning system of the third aspect of the present invention, wherein the control unit determines whether or not a first requester and a second requester are adjacent to each other based on data acquired by the state quantity data acquisition unit. The control unit then performs control such that local air-conditioning for the first requester is performed to an extent whereby the comfort assessment values of neighbors of the first requester excluding the second requester are kept within the predetermined range and the comfort assessment value of the first requester is within the predetermined range, in cases in which the control unit has determined that the first requester and second requester are adjacent to each other.

In the fourth aspect of the invention, the control unit is capable of perceiving adjacency between requesters even in cases in which the requesters are adjacent to each other. When performing a control such that the comfort assessment value of the first requester is within the predetermined range, the control unit performs a control to an extent such that the comfort assessment values of neighbors of the first requester excluding the second requester are kept within the predetermined range. Switching the first requester and the second requester, when performing a control such that the comfort assessment value of the second requester is within the predetermined range, the control unit performs a control to an extent such that the comfort assessment values of neighbors of the second requester excluding the first requester are kept within the predetermined range.

As a result, even in the case that two requesters are adjacent to each other, it is possible to perform a control for improving the comfort of both requesters while minimizing any increase in the processing load by not taking the other requester into account in the comfort control for either one of the requesters.

An air-conditioning system according to a fifth aspect of the present invention is the air-conditioning system of the third or fourth aspect of the present invention, further comprising an operation state data acquisition unit for acquiring data indicating the operation state of the air-conditioning unit. The control unit calculates the comfort assessment values of the requesters and neighbors on the basis of at least the position data records and the airflow rates and airflow temperatures determined from the operation state data. The airflow rates of local air-conditioning may be determined by, e.g., providing an air-blowing fan or the like to the air-conditioning unit and determining the airflow rates from the controlled rotational speeds of the air-blowing fan. The airflow temperatures of local air-conditioning may be determined by, e.g., attaching a sensor for detecting the discharged air temperature to the air conditioner and determining the airflow temperatures from the detected values. The refrigerant state (evaporation temperature, condensation temperature, etc.) may also be detected by a temperature sensor attached to a refrigerant pipe, and the airflow temperatures may be determined from these detected values.

In the fifth aspect of the invention, the control unit can calculate specific values for the comfort assessment values of the requesters and neighbors on the basis of at least the position data records and the airflow rates and airflow temperatures of local airflows.

It is thereby possible to assess the comfort of the requesters and neighbors more precisely, and to further improve the comfort of the requesters and neighbors through local air-conditioning.

An air-conditioning system according to a sixth aspect of the present invention is the air-conditioning system according to any of the first through fifth aspects of the present invention, further comprising an outside air processing unit for introducing outside air with its temperature adjusted into the target space. The control unit controls the extent of temperature adjustment in the outside air processing unit in accordance with the set temperature of the target space and the level of local air-conditioning of the air-conditioning unit. The level of local air-conditioning herein includes factors based on, e.g., the number of air-conditioning units performing local air-conditioning, the temperature difference between the locally air-conditioned area and the surrounding area, the flow rate, and other factors. The outside air processing unit may be a unit which, e.g., adjusts the temperature of outside air and blows the air into the target space at an adjusted flow rate. The extent of temperature adjustment in the outside air processing unit may be controlled by, e.g., performing control on the value of the adjusted temperature, the value of the adjusted airflow rate, or the like.

In the sixth aspect of the invention, the control unit can vary the level of temperature adjustment in the outside air processing unit in accordance with changes in the level of local air-conditioning, even if the level of local air-conditioning becomes extreme.

It is thereby possible to harmonize the level of local air-conditioning of the air-conditioning unit with the level of temperature adjustment in the outside air processing unit, and to avoid situations in which an increase in the level of local air-conditioning would make it difficult to keep the temperature of the target space in the vicinity of the set temperature.

An air-conditioning system according to a seventh aspect of the present invention is the air-conditioning system of the sixth aspect of the present invention, further comprising a target space temperature sensor for detecting the temperature of the target space. The control unit controls the extent of temperature adjustment in the outside air processing unit while performing control for forcibly causing the local air-conditioning of the air-conditioning unit to be continued, even in cases in which the temperature detected by the target space temperature sensor has reached the set temperature.

In the seventh aspect of the invention, the overall target space sometimes reaches the set temperature in cases such as when the extent of local air-conditioning has increased. The control unit can perceive this state by the value obtained from the target space temperature sensor, but the local air-conditioning of the air-conditioning unit can be forcibly continued. The comfort of the requester can thereby be reliably improved. Moreover, temperature adjustment control according to changes in the extent of local air-conditioning is performed by the outside air processing unit, whereby the temperature of the target space can be stabilized in the vicinity of the set temperature.

It is thereby possible to keep the temperature of the target space at the set temperature while giving priority to maintaining the local air-conditioning and securing the comfort of the requester.

An air-conditioning system according to an eighth aspect of the present invention is the air-conditioning system of the first or second aspect of the present invention, wherein the state quantity data acquisition unit has a movement data acquisition unit for acquiring data for estimating state quantities when the requester has moved into the target space.

Possible examples of the data for estimating state quantities include the body temperature of the requester, the temperature surrounding the requester, the humidity surrounding the requester, the number of steps taken by the requester, the time intervals of the strides taken by the requester (the pace between steps), and the like.

Herein, there is no need to continually perceive the position of the requester, and the metabolism rate of a requester moving into the target space can be estimated by a simple system.

An air-conditioning system according to a ninth aspect of the present invention is the air-conditioning system of the third or fourth aspect of the present invention, wherein the air-conditioning unit has an air-blowing fan and a discharge temperature sensor. The control unit calculates the comfort assessment value of the neighbor on the basis of at least the local air-conditioning airflow rates determined from the rotational speeds of the air-blowing fan, and the airflow temperatures determined from the discharge temperature sensor.

In cases of calculating the metabolism rates of neighbors in an adjacent position to a requester coming into the target space before the requester comes to an adjacent position, the metabolism rates can be calculated based on the local air-conditioning airflow rates determined from the rotational speeds of the air-blowing fan and the airflow temperatures determined from the discharge temperature sensor, without continually perceiving the neighbors' positions.

It is thereby possible to determine the metabolism rates of neighbors being therein before the requester comes to an adjacent position, through a simple system.

An air-conditioning system according to a tenth aspect of the present invention is an air-conditioning system for supplying conditioned air to a plurality of users located in a target space, the air-conditioning system comprising an air-conditioning unit, an estimated quantity data acquisition unit, and a control unit. The air-conditioning unit is capable of switching between local air-conditioning for directing airflows into part of the target space and overall air-conditioning for directing airflows throughout the entire target space. The estimated quantity data acquisition unit acquires data for estimating state quantities of a requester located in the target space. The control unit calculates comfort assessment values for assessing a predetermined range as being comfortable, the calculations being performed with respect to the requester on the basis of at least state quantities of the requester estimated from the data acquired by the estimated quantity data acquisition unit and the operating state of the air-conditioning unit, and the calculations being performed with respect to a neighbor of the requester on the basis of at least the operating state of the air-conditioning unit; and performs a control such that the local air-conditioning for the requester is performed to an extent whereby the comfort assessment value of the neighbor is maintained in the predetermined range and the comfort assessment value of the requester is within the predetermined range.

In the tenth aspect of the invention, the comfort of the requester sometimes changes due to changes in the environment surrounding the requester, even if the requester continues to be in the target space. To deal with such changes in comfort, data is acquired for estimating state quantities of the requester in the target space, and local air-conditioning suited to the changes in comfort can be performed for the requester. Therefore, the comfort of the requester can be quickly improved. Moreover, local air-conditioning is controlled such that the comfort assessment value of the neighbor is kept within the predetermined range.

It is thereby possible to minimize hindrances to the comfort of the neighbor while improving the comfort of the requester through local air-conditioning.

An air-conditioning system according to an eleventh aspect of the present invention is the air-conditioning system of the tenth aspect of the present invention, wherein the estimated quantity data acquisition unit further acquires data for estimating state quantities of the neighbor. The control unit calculates the comfort assessment value of the neighbor on the basis of at least the state quantities of the neighbor estimated from the data acquired by the estimated quantity data acquisition unit and the operating state of the air-conditioning unit.

To deal with the changes in comfort resulting from changes in the surrounding environment for not only the requester but the neighbor as well, data is acquired for estimating the state quantities of the neighbor located in the target space, and neighbor whose comfort level has changed can be taken into account when performing local air-conditioning for a requester.

An air-conditioning system according to a twelfth aspect of the present invention is the air-conditioning system according to the tenth or eleventh aspect, wherein the estimated quantity data acquisition unit has an environment sensor capable of detecting any one of the following data pertaining to the location of the user radiation quantity, temperature, humidity, and number of neighbors.

In the twelfth aspect of the invention, the estimated quantity data acquisition unit can have an inexpensive configuration.

An air-conditioning system according to a thirteenth aspect of the present invention is the air-conditioning system according to any of the tenth through twelfth aspects, wherein the control unit performs control for reducing the level of local air-conditioning in cases in which the comfort assessment value of the requester has reached within the predetermined range.

When the comfort assessment value of the requester is within the predetermined range and a comfortable environment has been successfully provided for the requester, there is no need to further continue the previous local air-conditioning, and the comfort of the requester is therefore not likely to be compromised even if the extent of local air-conditioning is reduced.

It is thereby possible to conserve energy by reducing local air-conditioning.

An air-conditioning system according to a fourteenth aspect of the present invention is the air-conditioning system according to the thirteenth aspect, wherein the control unit performs control such that local air-conditioning for the first requester is performed to an extent whereby the comfort assessment values of neighbors of the first requester excluding the second requester are kept within the predetermined range and the comfort assessment value of the first requester is within the predetermined range, in cases in which the control unit has determined that the first requester and second requester are adjacent to each other on the basis of data acquired by the estimated quantity data acquisition unit.

The control unit herein is capable of perceiving adjacency between requesters in cases in which the requesters are adjacent to each other. When performing a control such that the comfort assessment value of the first requester is within the predetermined range, the control unit performs a control to an extent such that the comfort assessment values of neighbors of the first requester excluding the second requester are kept within the predetermined range. Switching the first requester and the second requester, when performing a control such that the comfort assessment value of the second requester is within the predetermined range, the control unit performs a control to an extent such that the comfort assessment values of neighbors of the second requester excluding the first requester are kept within the predetermined range.

As a result, even in the case that two requesters are adjacent to each other, it is possible to perform a control for improving the comfort of both requesters while minimizing an increase in the processing load by not taking the other requester into account in the comfort control for either one of the requesters.

Advantageous Effects of Invention

According to the air-conditioning system of the first aspect of the present invention, it is possible to minimize any hindrance to the comfort of the neighbors while improving the comfort of the requester through local air-conditioning.

According to the air-conditioning system of the second aspect of the present invention, it is possible to conserve energy by reducing local air-conditioning.

According to the air-conditioning system of the third aspect of the present invention, it is possible to adjust the extent of local air-conditioning to an extent suited to the state of the requester by estimating the metabolism rate of the requester from the movement record.

According to the air-conditioning system of the fourth aspect of the present invention, even in the case that two requesters are adjacent to each other, it is possible to perform a control for improving the comfort of both requesters while minimizing an increase in the processing load by not taking the other requester into account in the comfort control for either one of the requesters.

According to the air-conditioning system of the fifth aspect of the present invention, it is possible to assess the comfort of the requesters and neighbors with greater detail, and to further improve the comfort of the requesters and neighbors through local air-conditioning.

According to the air-conditioning system of the sixth aspect of the present invention, it is possible to harmonize the extent of local air-conditioning of the air-conditioning unit with the extent of temperature adjustment in the outside air processing unit, and to avoid situations in which an increase in the extent of local air-conditioning would make it difficult to keep the temperature of the target space in the vicinity of the set temperature.

According to the air-conditioning system of the seventh aspect of the present invention, it is possible to keep the temperature of the target space at the set temperature while giving priority to maintaining the local air-conditioning and securing the comfort of the requester.

According to the air-conditioning system of the eighth aspect of the present invention, there is no need to continually determine the position of the requester, and the metabolism rate of a requester moving into the target space can be estimated by a simple system.

According to the air-conditioning system of the ninth aspect of the present invention, it is possible to determine the metabolism rates of neighbors being therein before the requester comes to an adjacent position, through a simple system.

According to the air-conditioning system of the tenth aspect of the present invention, it is possible to minimize any hindrance to the comfort of the neighbors while improving the comfort of the requester through local air-conditioning.

According to the air-conditioning system of the eleventh aspect of the present invention, neighbors whose comfort levels have changed can be taken into account when performing local air-conditioning for a requester.

According to the air-conditioning system of the twelfth aspect of the present invention, the estimated quantity data acquisition unit herein can have an inexpensive configuration.

According to the air-conditioning system of the thirteenth aspect of the present invention, it is possible to adjust the extent of local air-conditioning to an extent suited to the state of the requester by estimating the metabolism rate of the requester from the movement record.

According to the air-conditioning system of the fourteenth aspect of the present invention, even in the case that two requesters are adjacent to each other, it is possible to perform control for improving the comfort levels of both requesters while minimizing an increase in the processing load by not taking the other requester into account in the comfort control for either one of the requesters.

BRIEF DESCRIPTION OF THE DRAWINGS

FIG. 9 is a diagram showing the specific method of calculating the PMV.

DETAILED DESCRIPTION

An embodiment of an air-conditioning system 1 of the present invention is described with reference to the drawings.

<Configuration of Air-Conditioning System 1>

Figure 1:
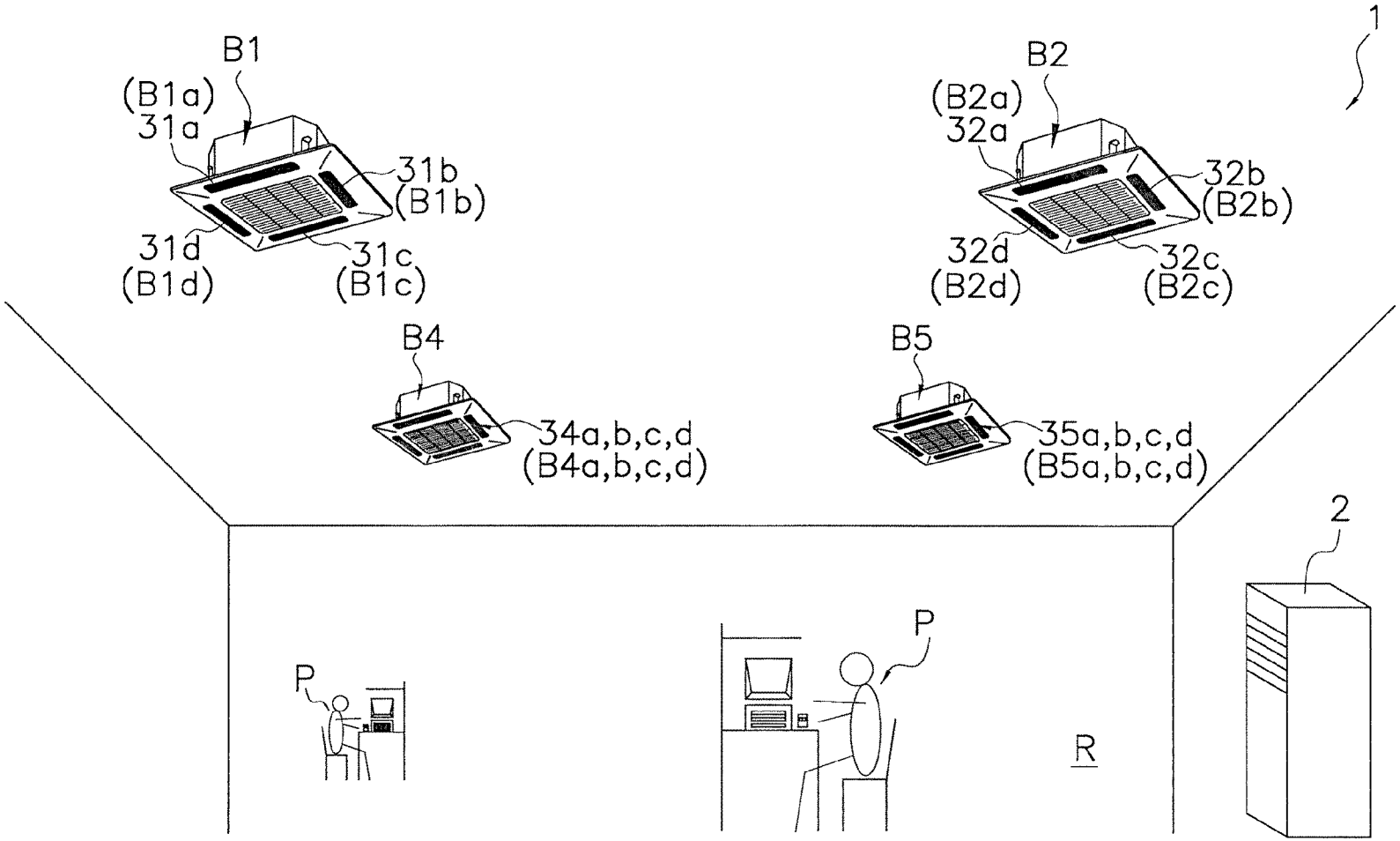
FIG. 1 is a schematic structural view of a building using an air-conditioning system according to an embodiment of the present invention.

FIG. 1 shows an external perspective view of an air-conditioning system 1 according to an embodiment of the present invention.

The air-conditioning system 1 is a system for performing air-conditioning control, wherein the levels of comfort of the air conditioning requester and of their neighbors (PMV: Predicted Mean Vote=comfort assessment value) are improved by a plurality of indoor units B1 to B9 disposed in a room R of a building used by a plurality of users P.

The term "requester" hereinbelow refers to a person returning to their own seat in the room R after being out of the room, and the term "neighbor" refers to one or more persons located within a predetermined distance (e.g., 1 m) from the requester. The term "user P" refers to a person using the system, without distinguishing between requester and neighbor.

Figure 2:
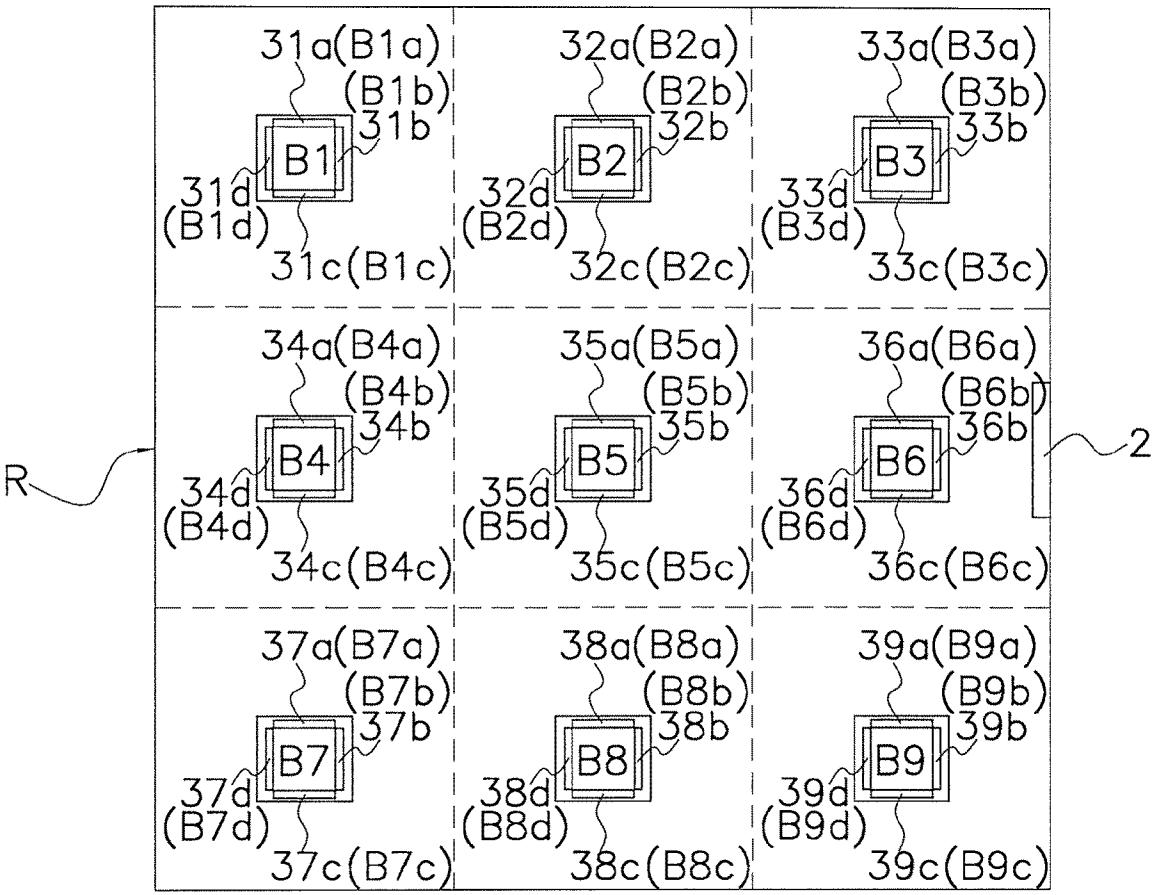
FIG. 2 is a drawing showing the placement of indoor units in the room.
Figure 3:
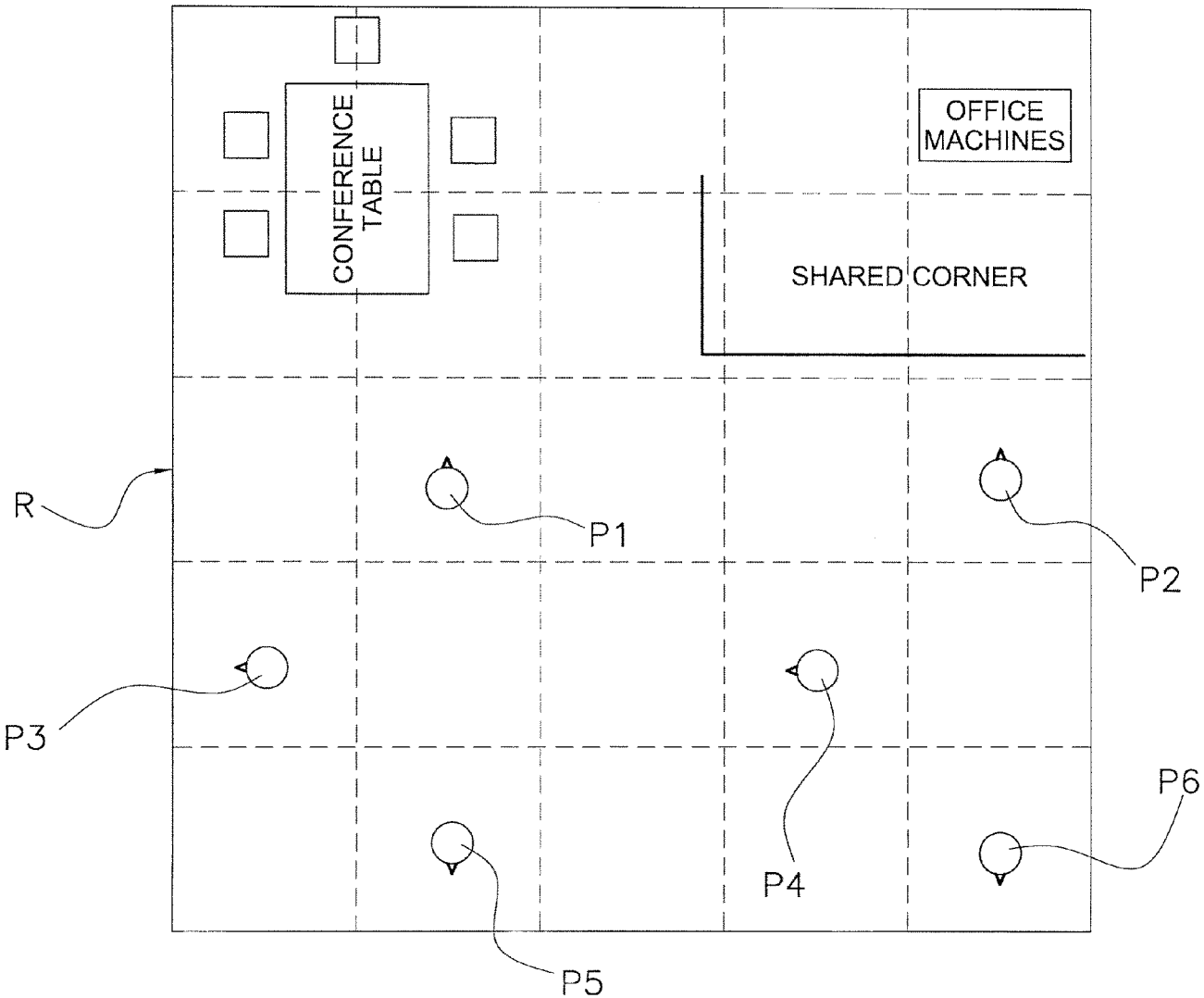
FIG. 3 is a diagram showing the positional relationship in a plan view between the air-conditioning system and the users.

The air-conditioning system 1 comprises a plurality of indoor units B1 to B9 disposed evenly within the room R, an outdoor unit (not shown) installed outside of the room, and an outside air processing air conditioner 2, as shown in FIG. 2. The room R is used partially by a plurality of users P1 to P6, as shown in FIG. 3.

The plurality of indoor units B1 to B9 are each provided with four discharge ports B1*a* to B9*d* in each of their four sides, as shown in FIG. 2. The indoor units B1 to B9 also have flaps 31*a* to 39*d* for adjusting the direction of airflow discharged from the discharge ports B1*a* to B9*d*.

Each of the flaps 31*a* to 39*d* of the indoor units B1 to B9 can selectively implement a normal operation and a local air-conditioning operation. The normal operation is performed by controlling the angles of inclination of the flaps 31*a* to 39*d* so that the discharged airflows are diffused. For example, the angles of the flaps 31*a* to 39*d* are maintained in four directions in a horizontal state, or are swung periodically. In the local air-conditioning operation, the operation is controlled so that the angles of inclination of the flaps 31*a* to 39*d* are fixed in place and conditioned air is blown intensively in a predetermined direction so as to create localized airflows.

With a local air conditioning control as described hereinafter, local air-conditioning is performed using the discharge ports of the indoor units B positioned in proximity to the users P1 to P6, and normal air conditioning is performed from the discharge ports of the indoor units B distanced from the users P1 to P6. The term "in proximity to the users P1 to P6" refers to the distance from a user P to the center of a discharge port of an indoor unit B being less than the second closest distance from among the indoor units B disposed in a matrix pattern. Specifically, in FIG. 2, this term refers to the distance between the centers of the air conditioner B1 and the air conditioner B5 positioned at diagonal with respect to the air conditioner B1.

The outside air processing air conditioner 2 is an air conditioner for performing heat exchange or the like by taking in outdoor air, and supplying fresh, conditioned air into the room R.

Figure 4:
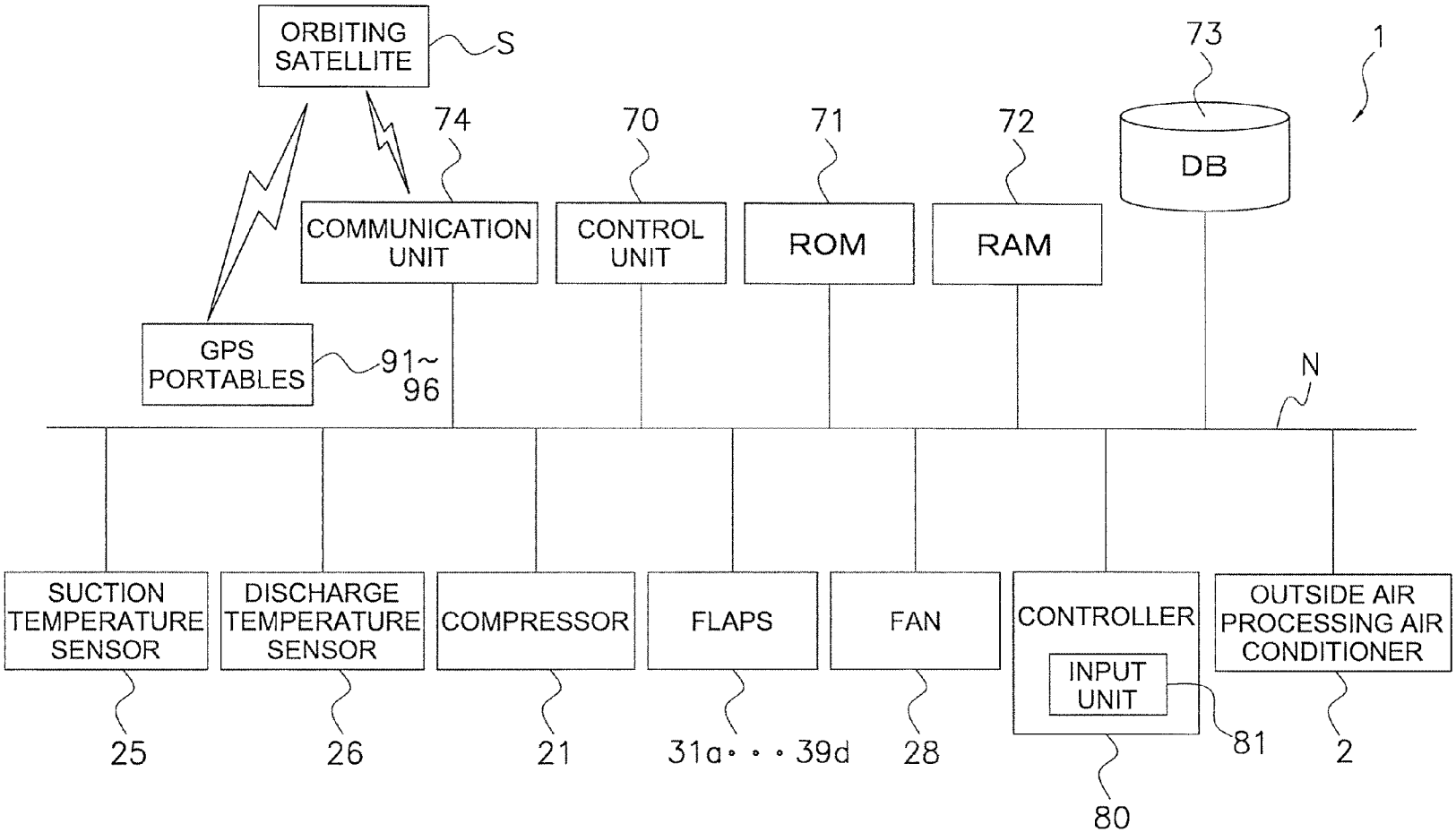
FIG. 4 is a block structural diagram of the air-conditioning system.

To perform operation control for the indoor units B1 to B9 and the outside air processing air conditioner 2, the air-conditioning system 1 comprises a control unit 70, a ROM 71, a RAM 72, a database 73, a communication unit 74, and GPS portable terminals 91 to 96, and these components are connected to each other by communication via communication wires N or an orbiting satellite S, as shown in FIG. 4.

The control unit 70 and other components are also connected via the communication wires N to a compressor 21 housed within the outdoor unit. Furthermore, the control unit 70 is also connected to each of the flaps 31*a* to 39*d* of the plurality of indoor units B1 to B9, and to fans 28, a suction temperature sensor 25, and a discharge temperature sensor 26. The air-conditioning system 1 is also configured so that a controller 80 having an input unit 81 is connected to the communication wire N, and various data can be inputted via the input unit 81. When a set temperature is inputted from the input unit 81 of the controller 80, the control unit 70 adjusts the temperature of the air sucked in through the intake ports of the indoor units B in accordance with a value detected by the suction temperature sensor 25, and a "THERMO OFF" mode is implemented when the value detected by the suction temperature sensor 25 reaches the set temperature (e.g., 27° C.). The indoor units B subjected to local air-conditioning control have their set temperatures varied so that the units do not go into THERMO OFF mode. Specifically, during cooling, the set temperature is lowered to, e.g., 18° C., whereby stable local air-conditioning control is continued. The outside air processing air conditioner 2 operates so that the value detected by the discharge temperature sensor 26 reaches the set temperature.

(Flaps 31*a* to 39*d*)

The flaps 31*a* to 39*d* are provided at respective positions corresponding to each of the discharge ports B1*a* to B9*d* in the four inner sides of the periphery in the bottom surface of each indoor unit B, so that the flaps extend parallel to each of the four sides. The control unit 70 implements a control so as to vary the angles of each of the flaps 31*a* to 39*d* of each indoor unit B with respect to each of the discharge ports B1*a* to B9*d*, and the discharged airflows can be directed toward the users P.

(Fans 28)

A fan 28 is provided to each indoor unit B, and the airflow rates discharged from the discharge ports B1*a* to B9*d* are adjusted by the control unit 70.

(Database 73)

The database 73 stores position information on each of the discharge ports B1*a* to B9*d* of the indoor units B1 to B9 disposed in the room R, as shown in FIG. 2.

Furthermore, the database 73 stores position information on the users P1 to P6 located in the room R, as shown in FIG. 3. A desk and chair are respectively provided at the seat of each user P, and position information on each user P is stored as position data indicating that the user P is sitting at their own seat, as shown in FIG. 3.

(GPS Portable Terminals 91 to 96)

The GPS portable terminals 91 to 96 are mobile communication terminals always carried by each of the users P1 to P6 when the users are in as well as out of the room R as shown in FIG. 3, and the GPS portable terminals 91 to 96 are used in communication with the orbiting satellite S so as to specify the locations of the users P1 to P6 holding the portables as shown in FIG. 4.

(Communication Unit 74)

The communication unit 74 exchanges data with the orbiting satellite S and acquires data on movement amount and movement speed through location records on the users P1 to P6 who work outside of the room and then return to the room R, as shown in FIG. 4.

<Local Air-Conditioning Control>

Figure 5:
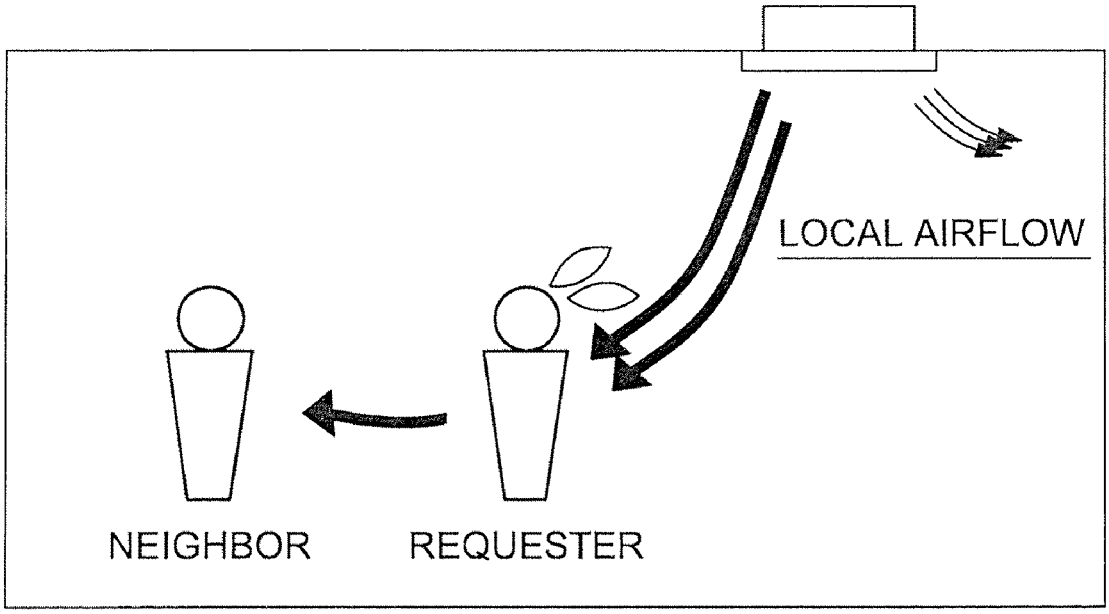
FIG. 5 is a drawing showing the positional relationship between a local airflow, a requester, and a neighbor.

Using the system configuration described above, the air-conditioning system 1 provides the desired comfort for the requester taking into account the positional relationship between the requester and the neighbor, performs local air conditioning by generating a local airflow to the requester, and performs local air-conditioning control with consideration for the neighbor so that the neighbor does not experience discomfort, as shown in FIG. 5. Local air-conditioning control is initiated when the requester returns to their own seat in the room R after being out of the room.

During local air-conditioning control, using the hot season of summer as an example, local air-conditioning is implemented so as to improve the PMV (Predicted Mean Vote=comfort assessment value) of a requester who has returned sweating to the room R after being outdoors, and control is performed so as to blow a large amount of cold air to the requester. Furthermore, control is implemented so that directing cold air to the requester does not result in the surroundings of the requester being cooled, the effect thereof extending to neighbors located around the requester, and the PMV of any neighbors deviating from the predetermined comfort range.

Figure 6:
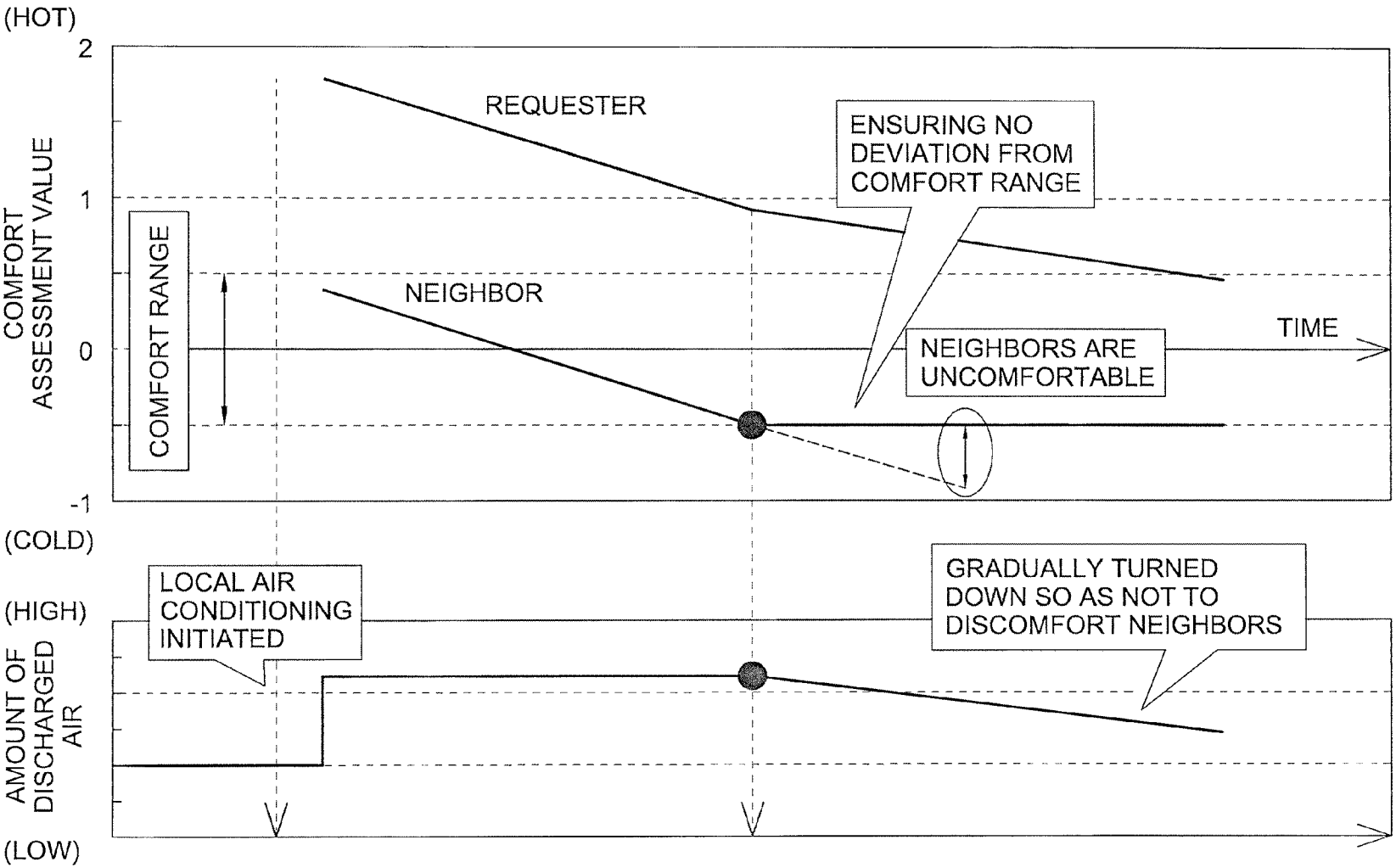
FIG. 6 is a diagram showing the change in the PMV value subjected to local air-conditioning control so that the neighbors are not uncomfortable.

Specifically, during local air-conditioning control, when the PMV comfort range is set to −0.5 or more and 0.5 or less, for example, the first consideration is that local air-conditioning be performed so that the PMV of the requester falls within the comfort range, and the level of local air-conditioning is controlled so that the PMV of the neighbors is also maintained within the comfort range as shown in FIG. 6. For example, if local air-conditioning becomes too great and the possibility of compromising the comfort of the neighbors increases (in the case that the comfort assessment value exceeds the predetermined value), control is performed for turning down the local air-conditioning.

Figure 7:
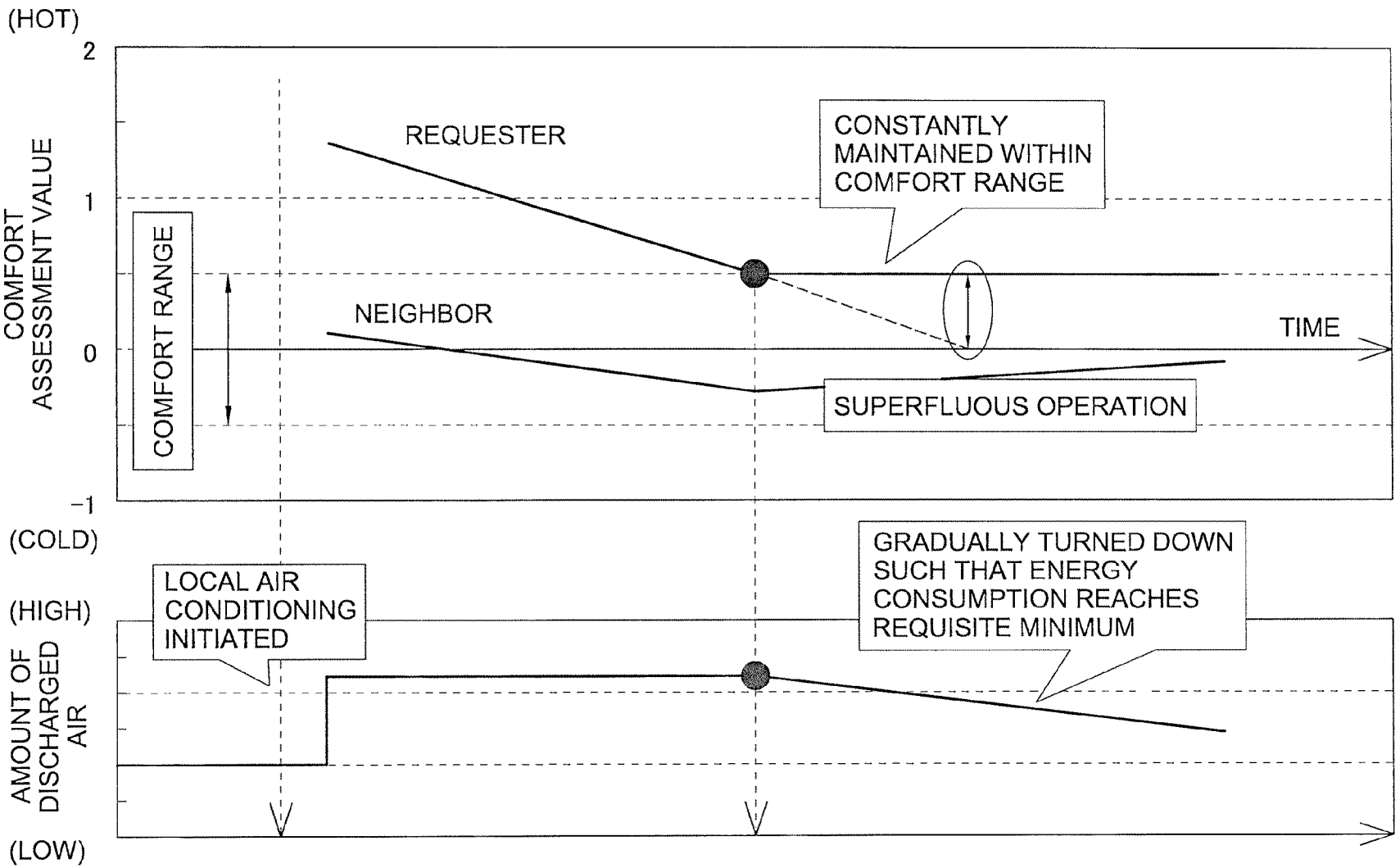
FIG. 7 is a diagram showing the change in the PMV value in a case of minimizing excessive local air-conditioning control for the requester.

During local air-conditioning control, the second consideration is that superfluous operation be avoided for the sake of energy conservation in the case that the PMV of the requester is successfully adjusted to the comfort range, and control is performed for maintaining the comfort range and turning down local air-conditioning, as shown in FIG. 7.

The control for turning down the local air-conditioning may involve lowering the airflow discharge rate so as to constantly maintain the PMV at the comfort range threshold (e.g., 0.5), for example, or lowering the airflow discharge rate by a predetermined amount (e.g., 20%) at predetermined time intervals (e.g., every minute).

The comfort range threshold, data of the predetermined time intervals and amounts whereby the discharged airflow rate is lowered, and other data can be found by testing subjects separately. The tests on these subjects are tests in which, e.g., the discharged direction and rate of local airflows and the metabolism rates of the subjects are varied as parameters, and the manner of change in the comfort experienced by the subjects as well as the individual differences therein and other factors are investigated for each parameter. Values supported by many subjects pertaining to comfort ranges and other factors are derived from the results obtained by subject testing, and these values may be used as reference values in this method.

Figure 8:
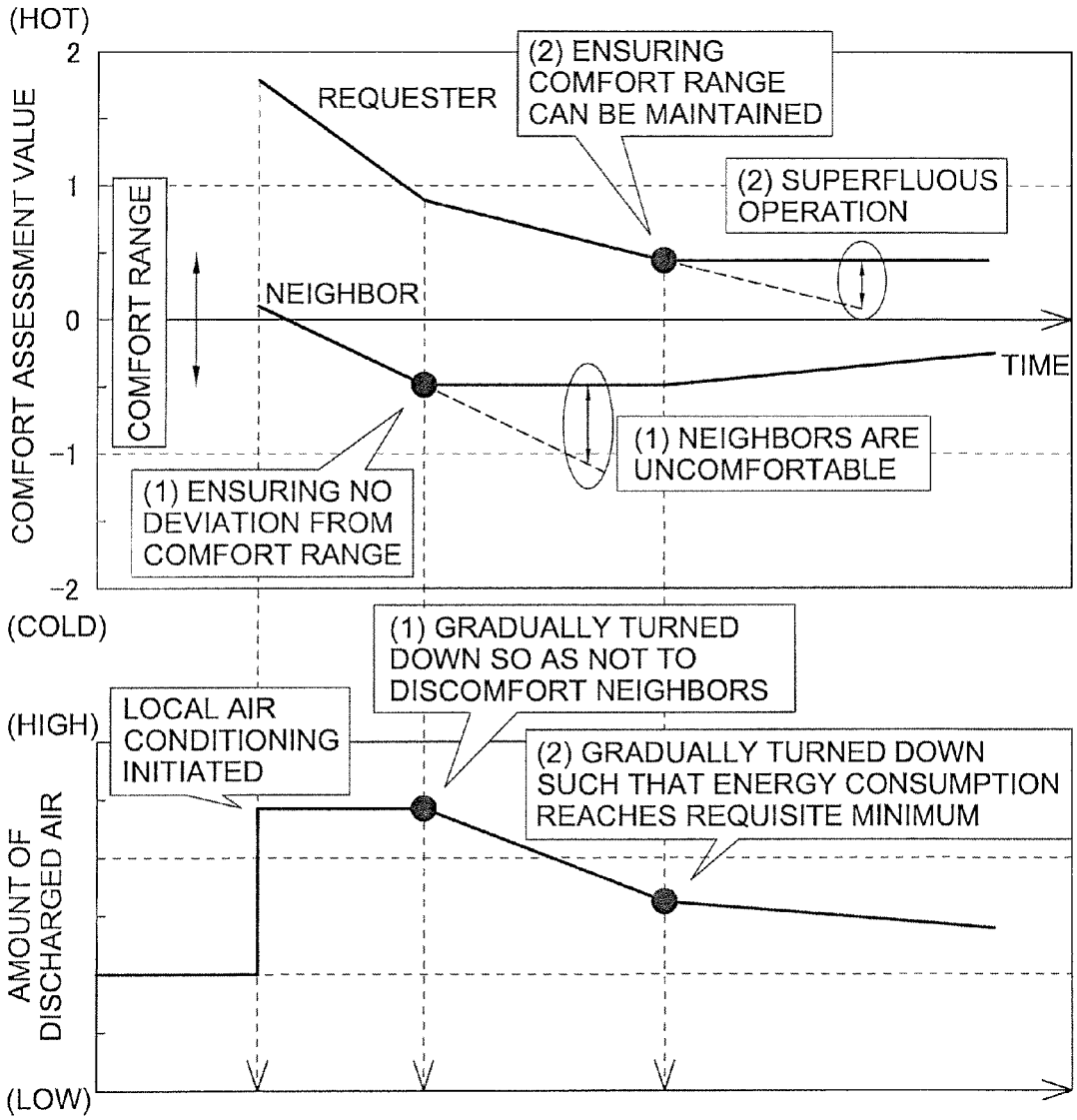
FIG. 8 is a diagram showing the change in the PMV value subjected to local air-conditioning control through energy conservation while neighbor discomfort is avoided.

As described above, local air-conditioning control is performed based on two considerations, the first being to prevent neighbor discomfort and the second being to conserve energy, whereby the PMVs of the requester and neighbors and the discharged airflow rates continue to undergo transitions as shown in FIG. 8.

This local air-conditioning is performed by the control unit 70 checking the position information on each of the discharge ports B1*a* to B9*d* of the indoor units B1 to B9 stored in the database 73 against the position information on the users P1 to P6 located in the room R, specifying the discharge ports of the indoor unit B located closest to the requester, and directing air to the requester from the specified discharge ports.

(PMV: Calculating Comfort Assessment Values)

The PMV is a function representing the comfort level, and is calculated for each requester and neighbor on the basis of the airflow temperature, airflow rate, relative humidity, radiation temperature, amount of clothing, and metabolism rate, as shown in FIG. 9.

Hypothetical conditions such as those shown in FIG. 9 are used pertaining to the room R and the discharge ports of the indoor units B. FIG. 9 shows specific examples of each value and specific calculation examples. The specific formula for the PMV is as follows.

$$PMV=(0.303e^{-0.36M}+0.028)[(M-W)-3.05\times 10^{-3}\{5733-6.99(M-W)-Pa\}-0.42\{(M-W)-58.15\}-1.7\times 10^{-5}M(5867-Pa)-0.0014M(34-t_a)-3.96\times 10^{-8}\times f_{cl}\{(t_{cl}+273)^4-(t_r+273)^4\}-f_{cl}\times h_c(t_{cl}-t_a)]$$

The control unit 70 finds the value of $t_{cl}$ through convergent calculation of the formula $t_{cl}=35.7-0.028\ (M-W)-I_{cl}\ [3.96\times 10^{-8}\times f_{cl}\ \{(t_{cl}+273)^4-(t_r+273)^4\}+f_{cl}\times h_c\ (t_{cl}-t_a)]$.

When $2.38\times(t_{cl}-t_a)^{0.25}>12.1\times(var)^{0.5}$, the value of $h_c$ equals to $2.38\ (t_{cl}-t_a)^{0.25}$, and when $2.38\times(t_{cl}-t_a)^{0.25}<12.1\times(var)^{0.5}$, the value of $h_c$ equals to $12.1\ (var)^{0.5}$.

When $I_{cl}<0.078\ m^{2\circ}$ C./W, i.e., when the amount of clothing is less than 0.5 clo, the value of $f_{cl}$ equals to $1.00+1.290\ I_{cl}$, and when $I_{cl}>0.078\ m^{2\circ}$ C./W, i.e., when the amount of clothing is greater than 0.5 clo, the value of $f_{cl}$ equals to $1.05+0.645\ I_{cl}$.

The value of W approaches zero.

$$pa=(RH/100)\times 6.11\times 10^{(7.5ta/(ta+273.3))}$$

Herein, $t_a$ is the airflow temperature (° C.), var is the airflow rate (m/s), RH is the relative humidity (%), $t_r$ is the radiation temperature (° C.), $I_{cl}$ is the thermal resistance ($m^{2\circ}$ C./W) of the clothing, ($I_{cl}$=0.155×amount of clothing clo), and M is the metabolism rate ($W/m^2$), (1 met=58 $W/m^2$).

The airflow temperature, the airflow rate, the relative humidity, the radiation temperature, the amount of clothing, and the metabolism rate are each described hereinbelow.

(Airflow Temperature)

Figure 10:
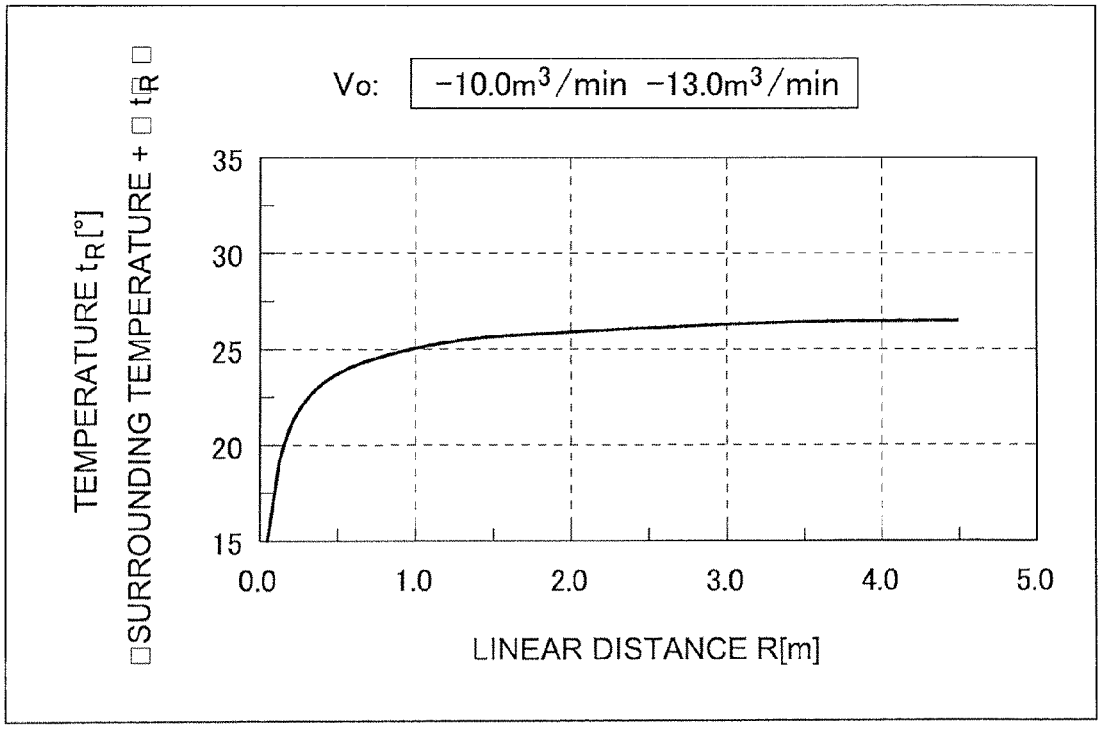
FIG. 10 is a diagram showing the characteristic formula for airflow temperature.

The airflow temperature $t_a$ is affected more by the surrounding air temperature at greater distances from the discharge ports to the requester, as shown in FIG. 10. Even when cold air of about 15° C. is discharged from a discharge port during cooling, the discharged air will have warmed to about 25° C. by the time it reaches a requester located about 1 m away from the discharge ports. The airflow temperature is calculated by using an airflow temperature characteristic formula, as shown in FIG. 10.

The expression $\Delta t_R$ in the characteristics formula denotes the temperature difference (° C.) between room temperature and the airflow temperature at a point in the distance R from the discharge port. The expression $\Delta t_0$ denotes the temperature difference (° C.) between room temperature and the airflow temperature in the vicinity of the discharge port, and the value detected by the discharge temperature sensor 26 is processed by the control unit 70. $V_0$ denotes the discharged airflow rate (m/s), K denotes a constant (e.g., 3.9 or the like) characteristic of the shape of the discharge ports, $H_0$ denotes the discharge port slit width (m) (e.g., 0.05 m), $R_0$ denotes the distance (m) (e.g., 0.40 m) from the center of the indoor unit to the center of a discharge port, θ denotes the angle (°) (e.g., 65°) formed by the discharge direction and the ceiling surface, and R denotes the linear distance (m) from the center of a discharge port. The airflow temperature within a distance r (e.g., 1 m) from the center of the local airflow has the following characteristics. First, the greater the amount of discharged air, the greater the temperature difference with the indoor temperature; and second, the longer the elapsed time from the start of local air-conditioning control, the greater the temperature difference with the indoor temperature. The neighbors' airflow temperatures are found through the following formula, for example.

$$\text{Airflow temperature: } t(r)=t_{room}-a\cdot e^{-br}$$

The variable $t_{room}$ denotes the indoor temperature. The coefficients a and b are as follows.

$$a=t_{room}-t(0)=t_{room}-t_a=\Delta t_R$$

$$b=k/V_0/T$$

The expression $\Delta t_R$ denotes the temperature difference (° C.) in the distance R from the discharge port, T denotes the elapsed time (min), and $V_0$ denotes the airflow discharge rate (m/s).

The coefficient k can be found to be 25.0 when, e.g., T=5 and $t(\mathbf{1})=\{t(\mathbf{0})+t_{room}\}/2$. This coefficient may also be found by actually measuring the thermal environment of the air-conditioned space.

(Airflow Rate)

Figure 11:
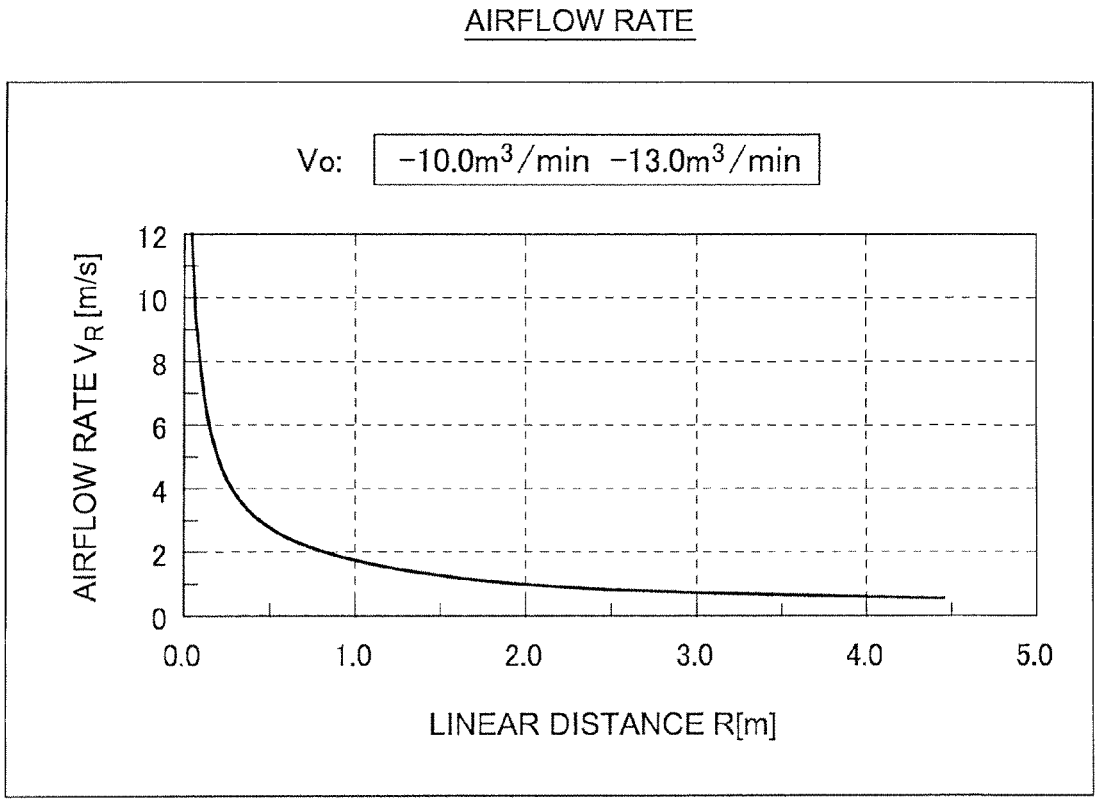
FIG. 11 is a diagram showing the characteristic formula for airflow rate.

The airflow rate var is such that the greater the distance from the discharge port to the requester, the lower the rate, as shown in FIG. 11. The airflow rate can be calculated by using an airflow rate characteristics formula, as shown in FIG. 11. Each of the coefficients herein have the same meaning as the coefficients of the airflow temperature characteristics formula described above. The airflow rate var is obtained by the control unit 70 processing the rotational speed of the fan 28 of the indoor unit B subjected to local air-conditioning control. The neighbors' airflow rates are assumed to be low (e.g., 0.2 m/s). Alternatively, these airflow rates are found based on a characteristics formula, similar to the airflow temperatures.

(Relative Humidity)

The relative humidity RH is found based on that the greater the distance from the discharge port to the requester, the more easily the relative humidity RH is affected by the surrounding air humidity, similar to the airflow temperature. For example, in the case of the cooling operation, the relative humidity RH is found based on that the greater the distance, the more the air humidity of the discharged airflow (the relative humidity is found to be approximately 90% from the characteristics of the air conditioner) is believed to approach the surrounding air humidity. The relative humidity is a variable dependent on the air temperature, and is therefore calculated by converting to absolute humidity.

(Radiation Temperature)

The radiation temperature $t_r$ approaches the indoor temperature. Specifically, the control unit 70 acquires the radiation temperature $t_r$ as the suction temperature of the indoor unit B.

(Amount of Clothing)

The amount of clothing clo is set in advance for each season, and the control unit 70 reads the value thereof on the basis of calendar information or the like stored in the database 73.

(Metabolism Rate)

Figure 12:
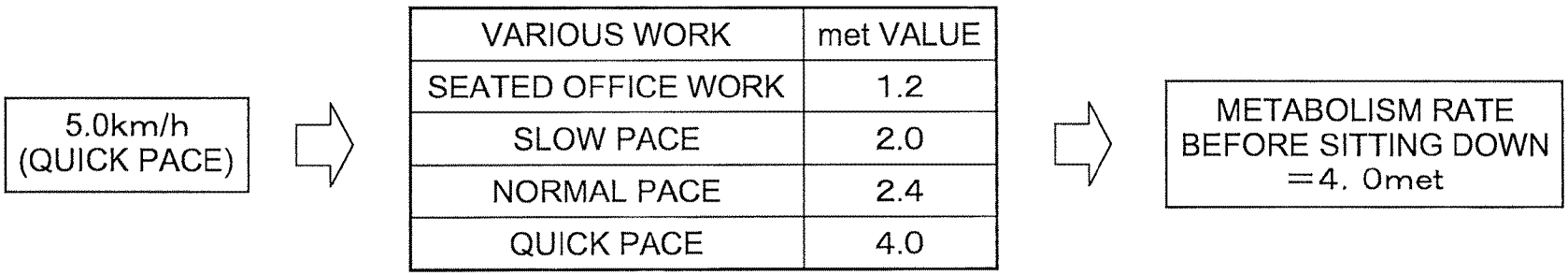
FIG. 12 is a diagram for processing met values and metabolism rates.

The communication unit 74 communicates via the orbiting satellite S with the GPS portable terminals held by the requester, whereby the control unit 70 calculates the amount and speed of movement for a time extending from the present time to a predetermined time, and the metabolism rate M is determined. For example, when the movement speed is 5 km/h as shown in FIG. 12, the pace is concluded to be quick, the data read from the database 73 is correlated, and the metabolism rate of the user before the user sits back down is thereby found to be 4.0 met. Note that when the movement speed is near 0 km/h, it is concluded that the user is doing office work, and the metabolism rate is set at 1.2 met.

Figure 13:
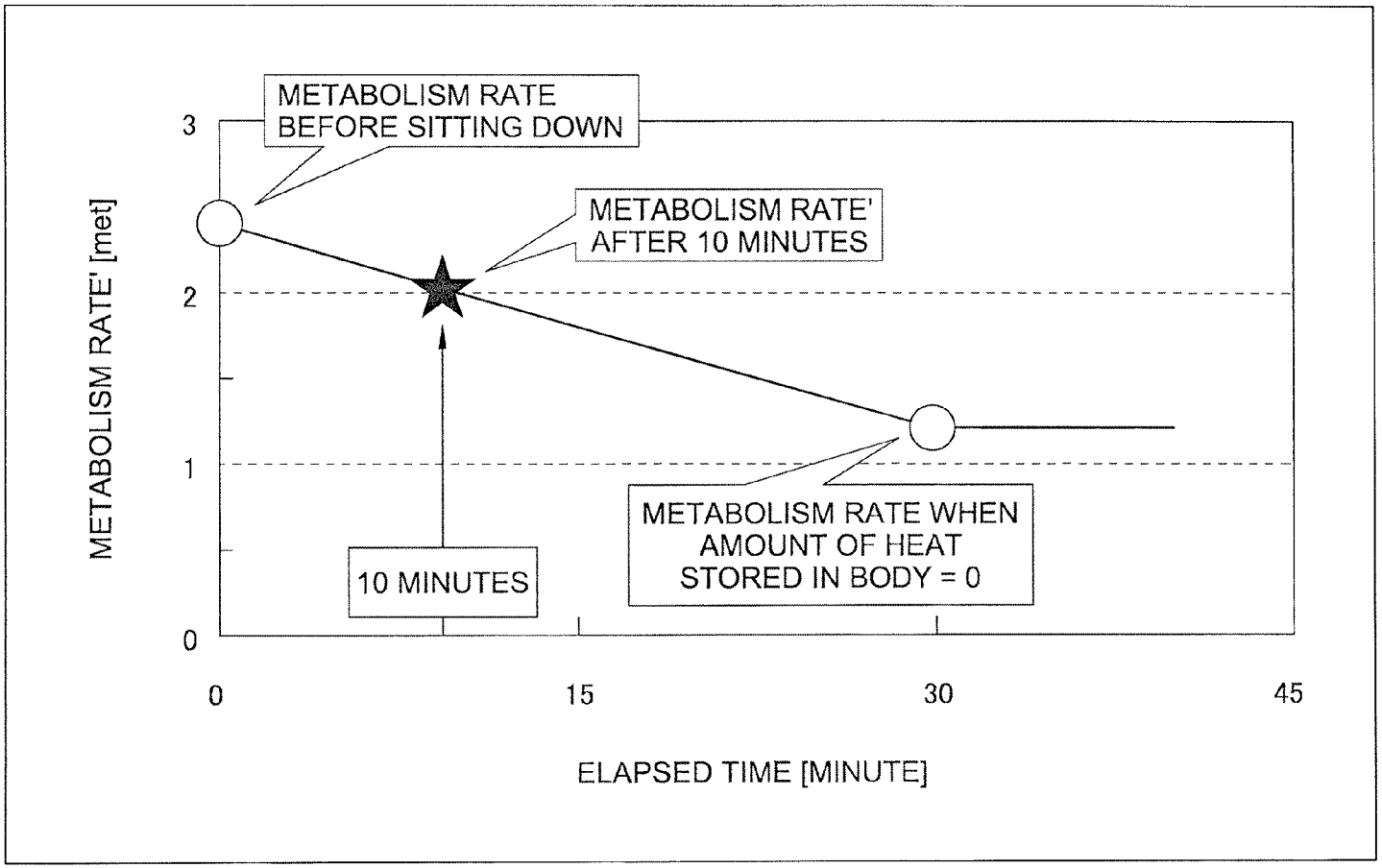
FIG. 13 is a diagram showing the transition in metabolism rate over time.

The amount of heat stored in the human body decreases after a while from a certain state reached by the requester moving outdoors, and the metabolism rate is the value of only the metabolism rate during seated work when the amount of heat stored in the human body has reached zero, as shown in FIG. 13. The change over time in the metabolism rate may be assumed to decrease steadily, but since this change is affected by the temperature and rate of the discharged airflow, the relational expression is preferably derived separately by subject testing, and this derived result is then used.

Figure 14:
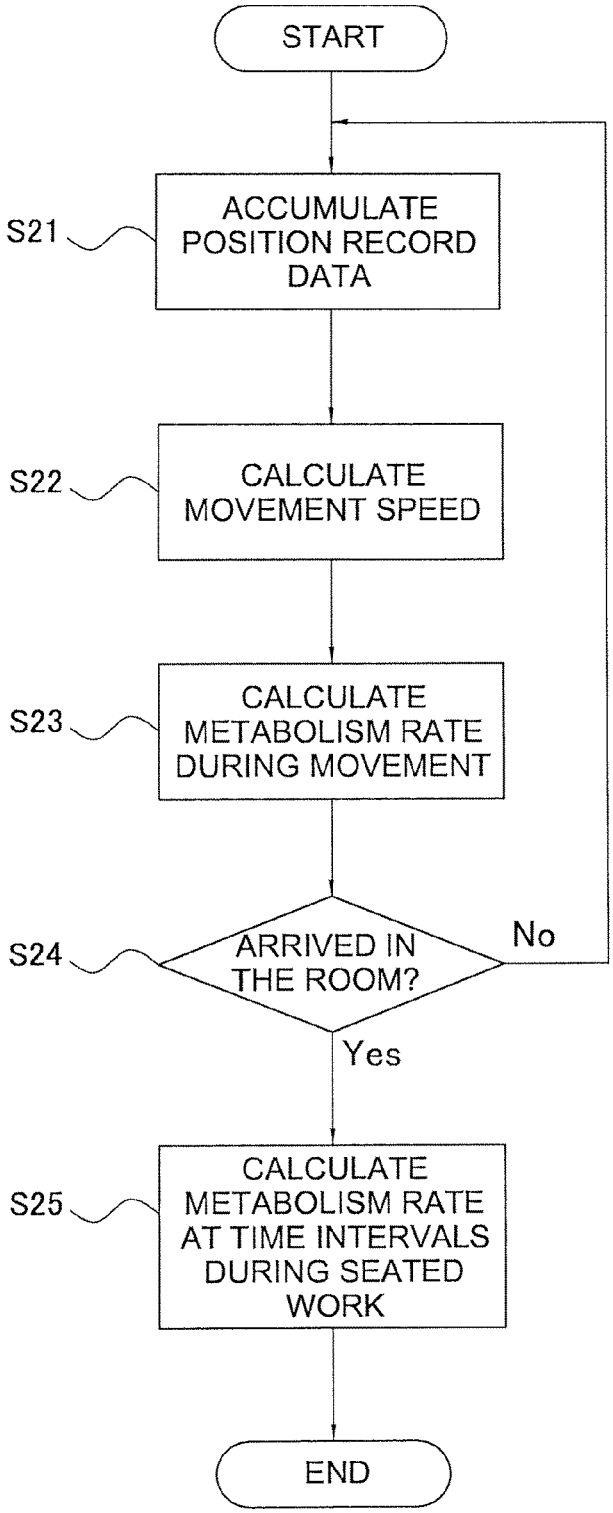
FIG. 14 is a flowchart when the metabolism rate is calculated.

The metabolism rate of the requester is calculated based on a flowchart such as is shown in FIG. 14.

In step S21, the control unit 70 stores position record data on the requester on the basis of communication between the communication unit 74 and GPS portable terminal via the orbiting satellite S.

In step S22, the control unit 70 calculates the movement speed (estimated value) of the requester by analyzing the position record data at time intervals.

In step S23, the control unit 70 calculates the metabolism rate (estimated value) corresponding to the amount of heat stored in the human body when the requester is moving, on the basis of the movement speed of the requester.

In step S24, the control unit 70 determines whether or not the requester has arrived in the room R from the communication between the communication unit 74 and GPS portable terminal via the orbiting satellite S. In the case that the requester has arrived in the room R, the process advances to step S25, and otherwise the process returns to step S21 and repeats.

In step S25, the control unit 70 reads from the database 73 the metabolism rate during movement (before sitting down) corresponding to the amount of heat stored in the human body and the met value corresponding to the work of the requester, and calculates a metabolism rate reflecting the reduction in the amount of heat stored in the human body after sitting down.

For the metabolism rate of a neighbor, assuming the neighbor is a desk worker always in the room, for example, it is practical to easily use a desk worker standard value (met value=1.2). In the case that the neighbor was successfully confirmed to be comfortable at the start of local air-conditioning, a metabolism rate at which PMV=0 at the start of local air-conditioning is found through reverse calculation, and the value thereof may be used. The metabolism rate of the neighbor may also be calculated by the same method as with the requester.

Specifically, since the neighbor does not carry GPS portable terminals 91 to 96, the metabolism rate cannot be found from movement. However, the airflow temperature, airflow rate, relative humidity, and radiation temperature needed to calculate the neighbor's PMV can be found from each sensor in the indoor unit B, the amount of clothing can be found based on the calendar information, and the metabolism rate can be found using the desk worker reference value (met value=1.2) as described above, whereby the control unit 70 can calculate the neighbor's PMV as well. The PMV of the neighbors may be found in this manner.

Particularly, the control unit 70 can easily calculate the airflow rate from data on the rotational speed of the fan 28. The airflow temperature can be easily obtained as a value detected by the discharge temperature sensor 26.

(Change Over Time in Respective Parameters)

Figure 15:
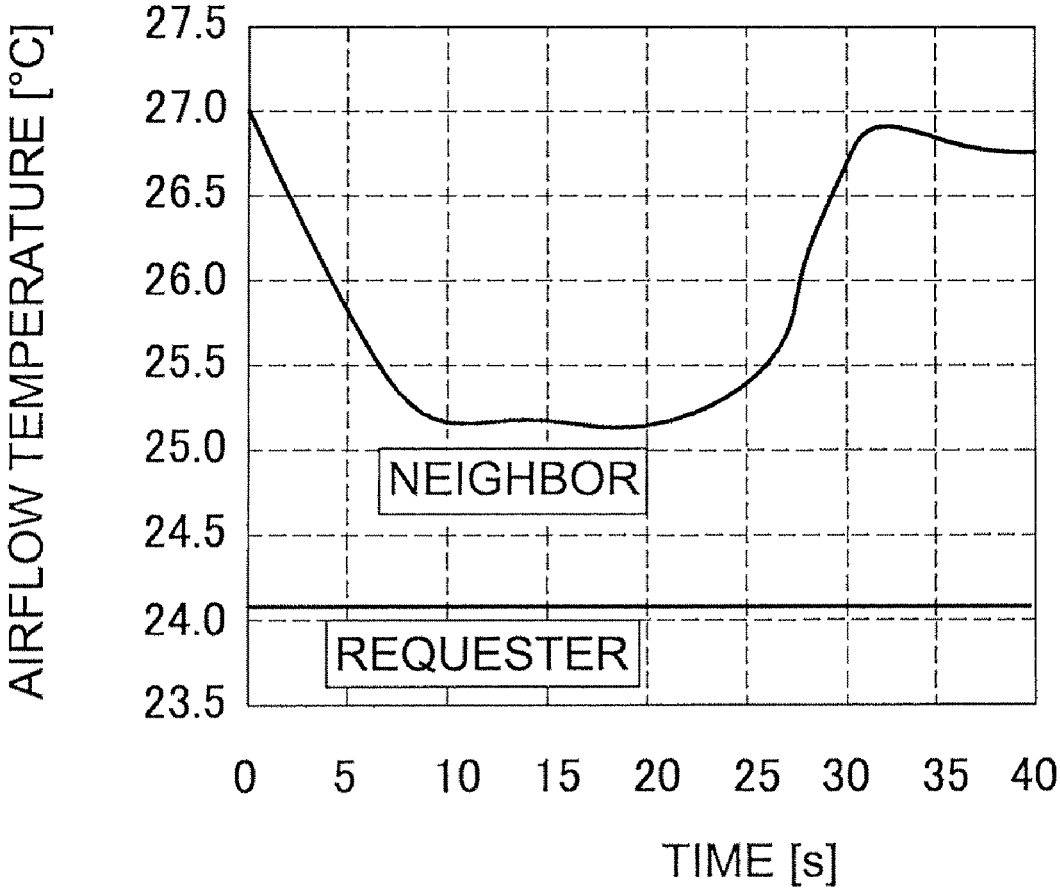
FIG. 15 is a diagram showing the change over time in airflow temperatures for the requester and neighbors.
Figure 16:
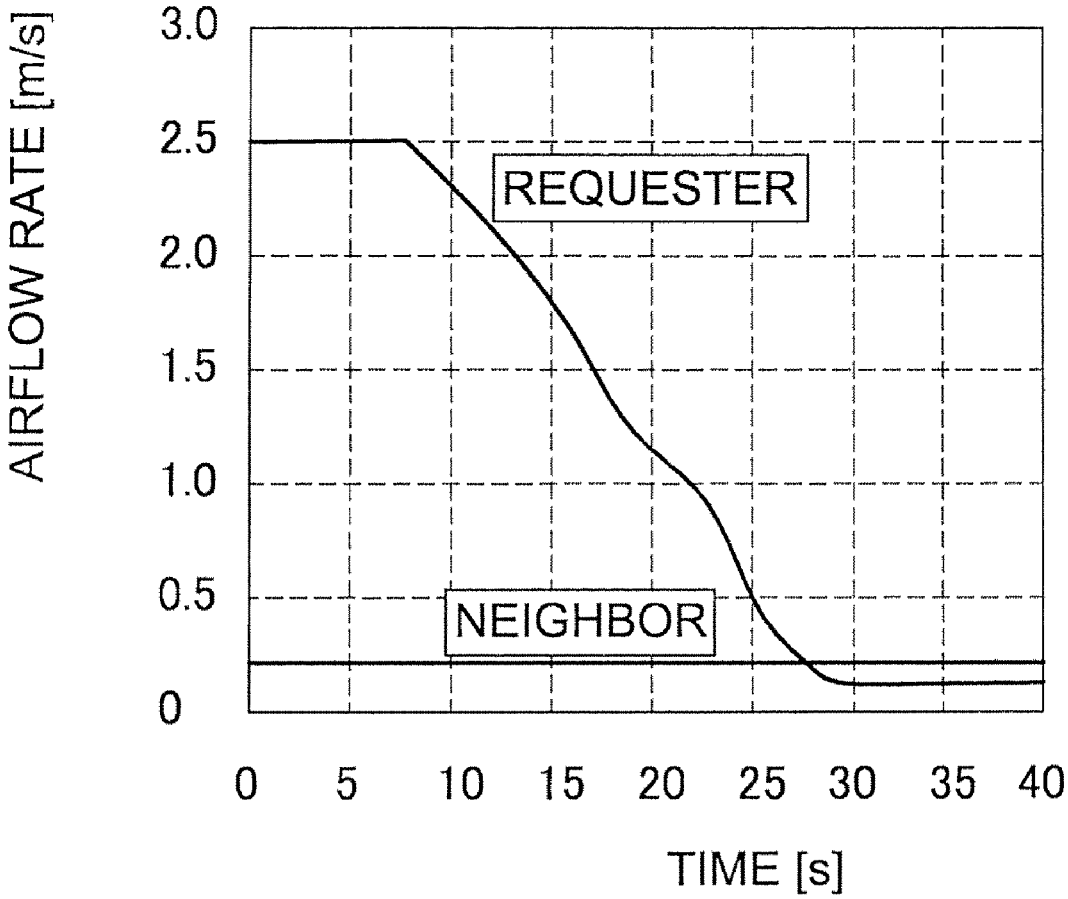
FIG. 16 is a diagram showing the change over time in airflow rates for the requester and neighbors.
Figure 17:
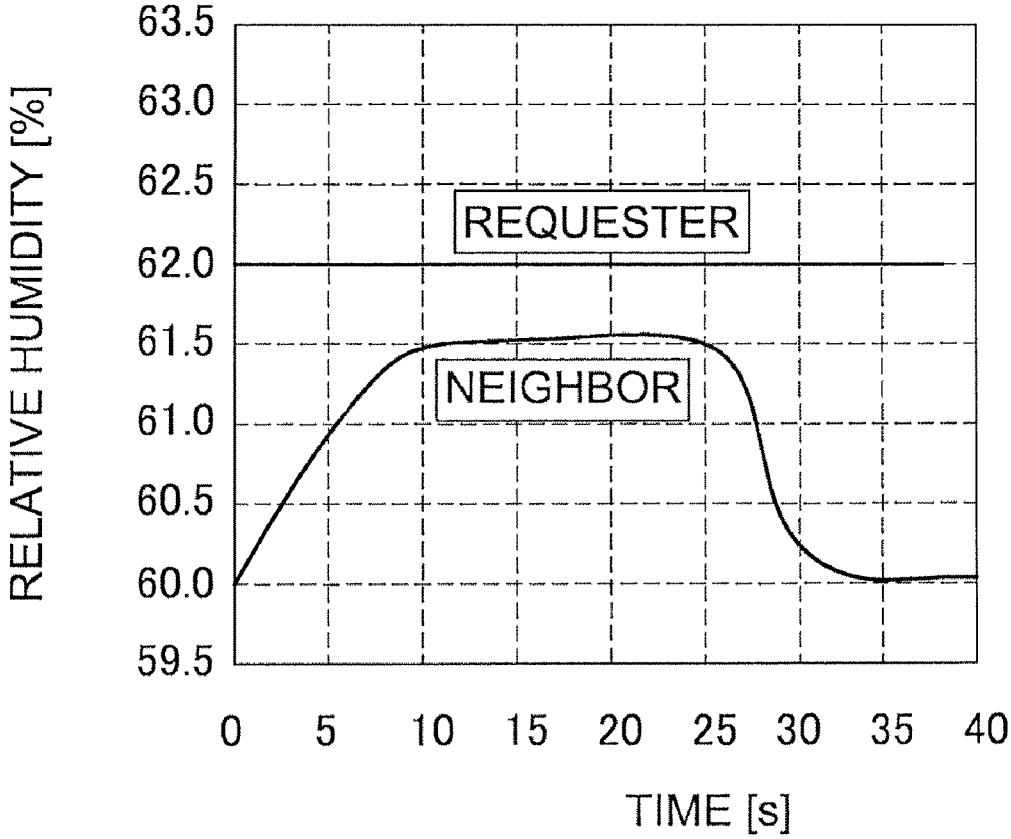
FIG. 17 is a diagram showing the change over time in relative humidities for the requester and neighbors.
Figure 18:
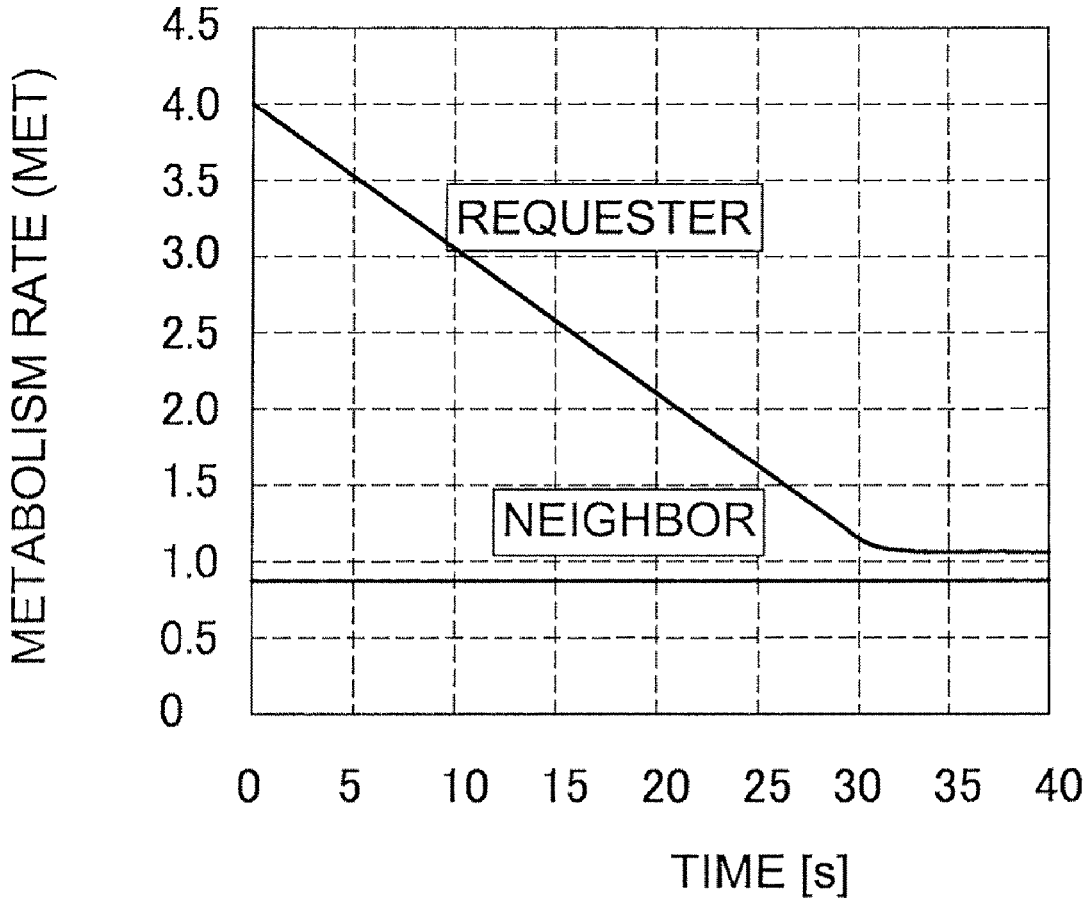
FIG. 18 is a diagram showing the change over time in metabolism rates for the requester and neighbors.
Figure 19:
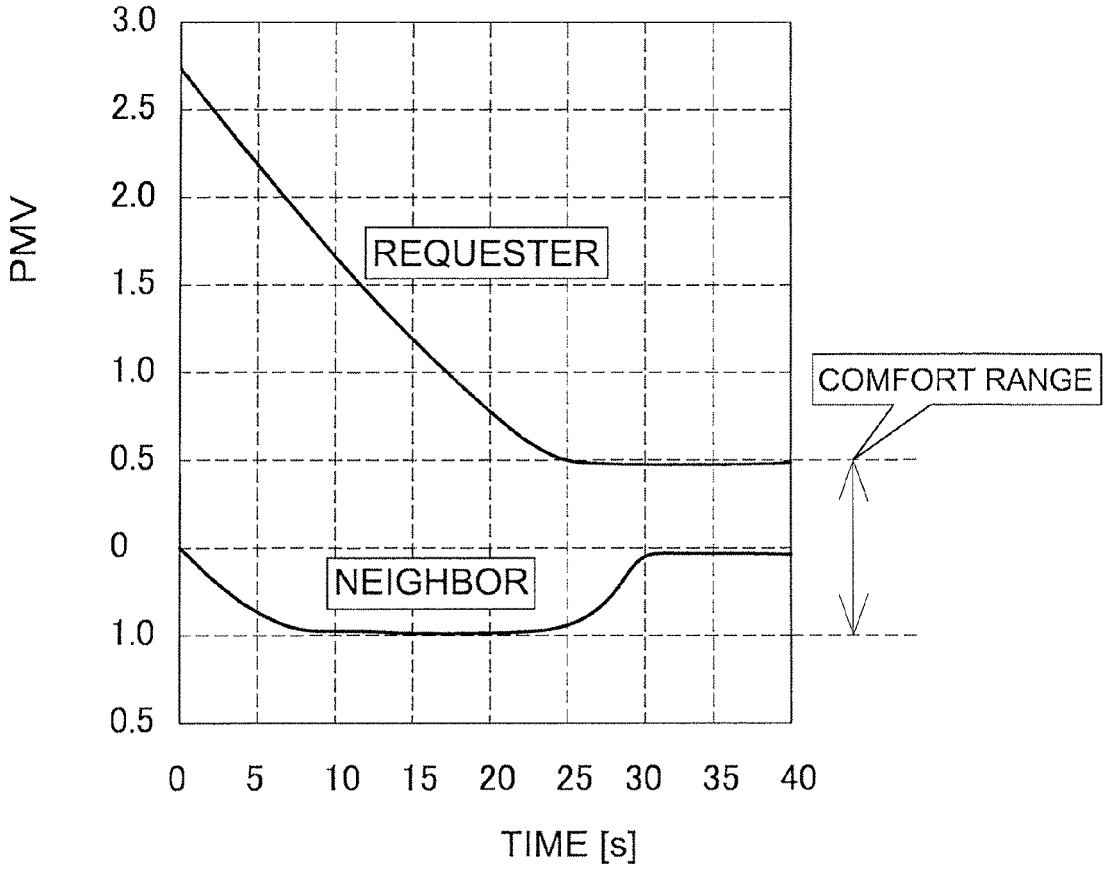
FIG. 19 is a diagram showing the change over time in PMVs for the requester and neighbors.
Figure 20:
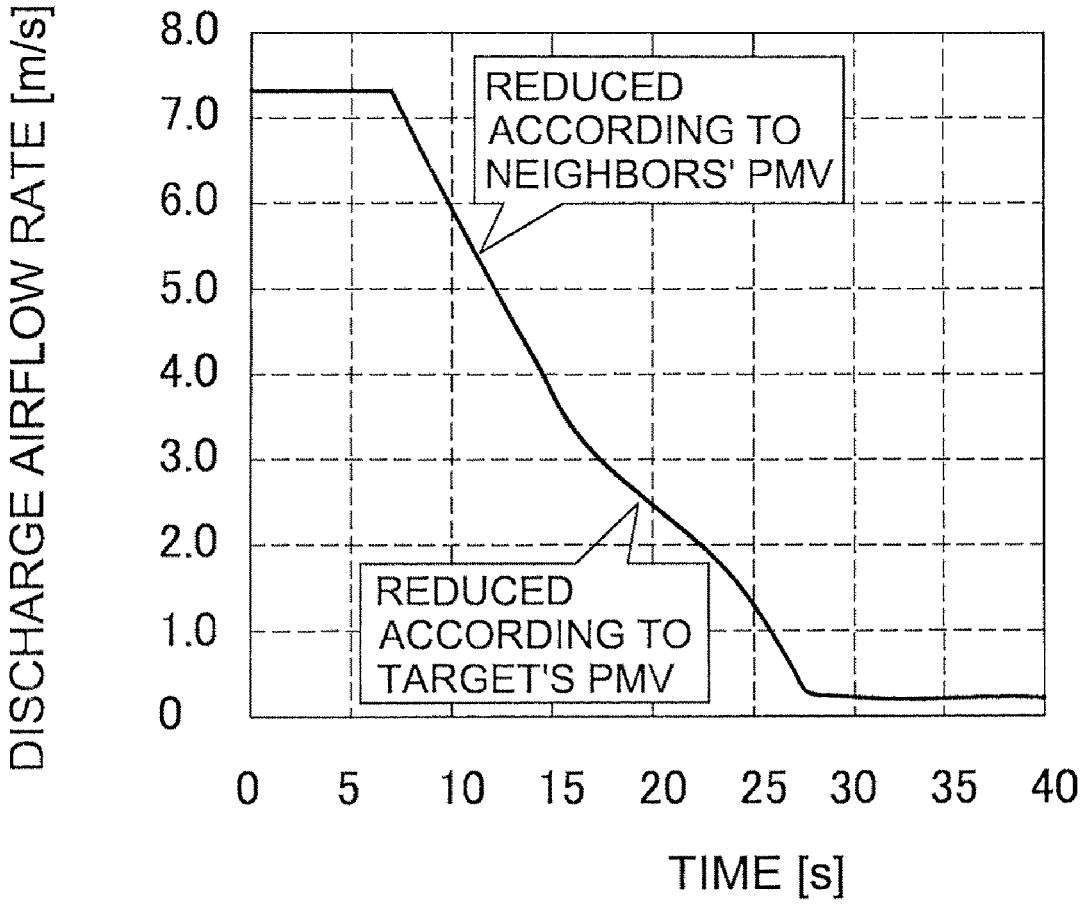
FIG. 20 is a diagram showing the change over time in discharge rates for the requester and neighbors.
Figure 21A:
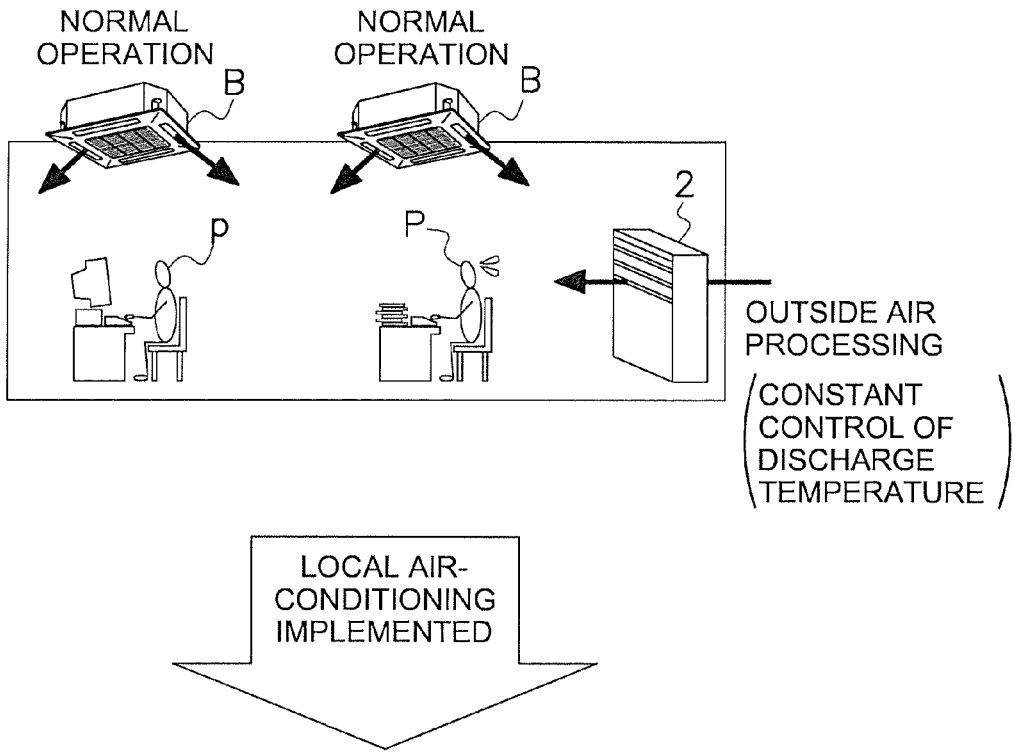
FIG. 21(*a*) is a drawing showing load adjustment control by an outside air processing air conditioner in a case of low-level local air-conditioning control, and FIG. 21(*b*) is a drawing showing load adjustment control by the outside air processing air conditioner in a case of high-level local air-conditioning control.
Figure 21B:
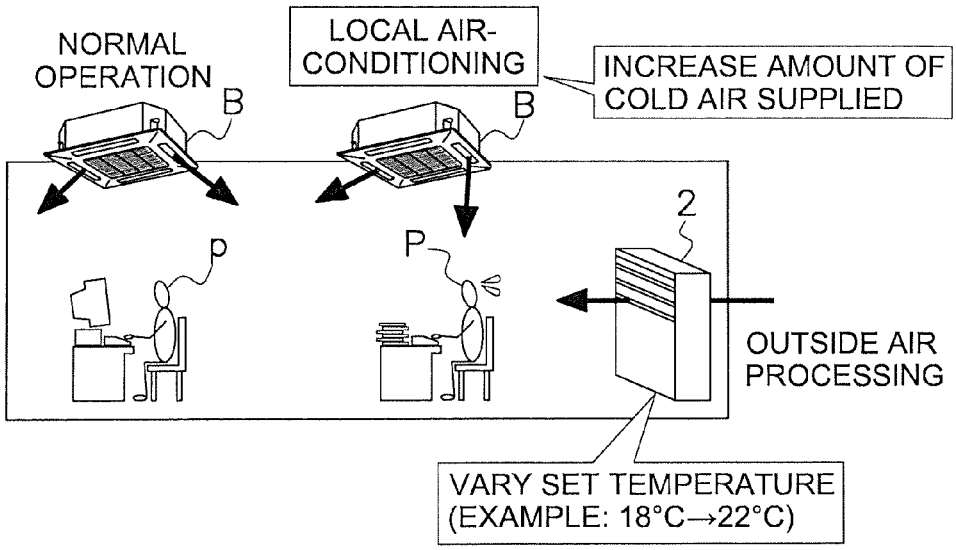

Concerning a case in which the amount of clothing is 0.6 clo and the radiation temperature is 27° C. for both a requester experiencing a local airflow from local air-conditioning control and their neighbors (people at a distance of 1 m from the requester), FIG. 15 shows a graph of the change over time in airflow temperature, FIG. 16 shows a graph of the change over time in airflow rate, FIG. 17 shows a graph of the change over time in relative humidity, FIG. 18 shows a graph of the change over time in metabolism rate, FIG. 19 shows a graph of the change over time in PMV, and FIG. 20 shows a graph of the change over time in discharge flow rate.

The airflow temperature changes so that the value pertaining to the neighbors approaches the value pertaining to the requester by local air-conditioning control.

The airflow rate pertaining to the requester decreases when the requester's PMV reaches the comfort range or at a timing at which the neighbors' PMV deviates from the comfort range. During the cooling operation, the relative humidity is gradually increased by the local air-conditioning control for the requester along with the decrease in the airflow temperature.

The metabolism rate remains constant for the neighbors, whereas the metabolism rate for the requester decreases to the same value as the neighbors after local air-conditioning control is initiated when the requester sits down, and the metabolism rate thereafter remains constant.

The PMV for the requester begins to decrease after local air-conditioning is initiated when the requester sits down and then levels off when the comfort range is reached, and the PMV for the neighbors is changed so as not to deviate from the comfort range while being affected by the local air-conditioning for the requester. The airflow rate is calculated to be substantially 0 when the distance from the center of the local airflow is about 0.5 m or greater, and since the indoor airflow rate is usually about 0.2 m/s even in its low state, a value of 0.2 m/s was used for the airflow rate when calculating the PMV.

The discharge airflow rate is reduced according to the neighbors' PMV starting at the point when the neighbors' PMV falls below a predetermined value (e.g., −0.4) so as not to compromise the neighbors' comfort, and is further reduced according to the metabolism rate PMV of the requester starting at the point when the PMV of the requester enters the comfort range.

Thus, it is possible to quickly make the requester comfortable by local air-conditioning control, and to ensure that the neighbors are not affected in an uncomfortable manner.

<Control of the Outside Air Processing Air Conditioner 2>

As described above, the indoor units B and the outside air processing air conditioner 2 are controlled by the control unit 70 to operate so that the room R is maintained at the set temperature. In the case that the room R has reached the set temperature; i.e., in the case that the suction temperatures of the indoor units B have become equal to the set temperature, indoor units B not subjected to local air-conditioning control are set to the THERMO OFF mode. On the other hand, indoor units B subjected to local air-conditioning control continue being so controlled even if they have reached the set temperature.

Thereby, in cases in which the number of requesters returning to the room R from outdoors increases, the number of indoor units B subjected to local air-conditioning control also increases, and an excess of cold air is therefore supplied to the room R during the cooling operation.

Therefore, when the temperature in the room R falls below the set temperature during the cooling operation, the control unit 70 performs a control for raising the set temperature (e.g., raising the temperature to 22° C. when the discharge temperature setting is 18° C.) only for the outside air processing air conditioner 2 (discharge temperature constant control is performed).

As a result, even in cases in which the number of indoor units B subjected to local air-conditioning control increases and the amount of cold air supplied into the room R increases, it is possible to avoid situations in which the indoor temperature falls below the set temperature and the room becomes too cold.

<Characteristics of Air-Conditioning System 1>

(1)

With the air-conditioning system 1 of the embodiment described above, PMVs are calculated for both the requester and the neighbors, neighbor discomfort caused by local air-conditioning control for the requester can be avoided, and the comfort of the requester can be improved.

(2)

With the air-conditioning system 1 of the embodiment described above, in cases in which the requester's PMV enters the comfort range due to local air-conditioning control, the local airflow is reduced or the discharge temperature is mildly reduced for the indoor unit B subjected to local air-conditioning control, whereby an energy-conserving operation can be per formed while maintaining the comfort of the requester.

(3)

With the air-conditioning system 1 of the embodiment described above, even if the number of indoor units B subjected to local air-conditioning control increases, control is performed for reducing the output of the outside air processing air conditioner 2 in proportion to the increase, whereby the indoor temperature can be maintained close to the set temperature.

<Modifications>

An embodiment of the present invention was described above based on drawings, but the specific configuration is not limited to this embodiment, and modifications can be made so long as they do not deviate from the scope of the invention, as shown hereinbelow.

(A)

For the air-conditioning system 1 of the embodiment described above, an example of a configuration was given in which four discharge ports were provided along each of the four sides constituting the contours of the indoor units, and an example was described in which local airflows were allowed to be discharged from each discharge port.

However, the present invention is not limited to such a configuration, and instead of indoor units provided with discharge ports in four directions, for example, it is possible to use indoor units capable of controlling local airflows in predetermined directions and airflow rates.

(B)

For the air-conditioning system 1 of the embodiment described above, an example of a system was described in which GPS portable terminals 91 to 96 and a GPS were used as mobile communication terminals.

However, the present invention is not limited to such a configuration, and a system may be used wherein position information (position record, amount of movement) is collected by another method, for example.

The system for acquiring position information may be, e.g., a system wherein a mobile communication terminal having a wireless LAN function is carried by the user P in advance, and position information is obtained through communication with a wireless LAN base station.

Another option is, e.g., a system wherein the user P carries an RFID tag in advance, and position information is obtained through communication using a ubiquitous sensor network.

(C)

For the air-conditioning system 1 of the embodiment described above, an example was described in which a PMV was used as an indicator for assessing comfort.

However, the present invention is not limited to such a configuration, and other possible options of comfort indicators include, e.g., new standard effective temperature (SET), new effective temperature (*ET), operative temperature (OT), discomfort index (DI), effective temperature (ET), corrected effective temperature (CET), and Wet Bulb Globe Temperature (WBGT), and the like.

(D)

For the air-conditioning system 1 of the embodiment described above, an example was described in which requesters were not adjacent to each other.

However, the present invention is not limited to such a configuration, and local air-conditioning control may be performed as follows in a case in which, e.g., requesters are adjacent to each other within a predetermined distance (e.g., within 1 m).

Specifically, in this case, the control unit 70 performs local air-conditioning control independently for each of the requesters adjacent to each other. One of the mutually adjacent requesters is denoted as the first requester, and the other is denoted as the second requester.

Specifically, for local air-conditioning control for the first requester, the comfort assessment values of the neighbors are calculated and the control unit 70 performs a control so that the PMVs for each of the plurality of neighbors around the first requester, excluding the second requester, do not deviate from the comfort range. The control unit 70 calculates the requester's comfort assessment value and performs local air-conditioning control so that the PMV of the first requester quickly reaches the comfort range.

Meanwhile, for local air-conditioning control for the second requester, the comfort assessment values of the neighbors are calculated and the control unit 70 performs a control so that the PMVs for each of the plurality of neighbors around the second requester, excluding the first requester, do not deviate from the comfort range. The control unit 70 calculates the requester's comfort assessment value and performs local air-conditioning control so that the PMV of the second requester quickly reaches the comfort range.

In other words, control is performed on the basis that the neighbors are people not requesting local air-conditioning (i.e., they are currently comfortable), and are located adjacent to the requesters.

Thus, even in cases in which a plurality of requesters are adjacent to each other, the comfort of each of the requesters can be quickly ensured by performing local air-conditioning control independently for each requester, without complicating the calculation process and without making the neighbors uncomfortable through the local air-conditioning control.

(E)

For the air-conditioning system 1 of the embodiment described above, an example was described in which the requester was a person who had returned to their own seat in the room R after having been outdoors.

However, the present invention is not limited to such a configuration, and the requester may also be, e.g., a person who has returned to their own seat and requested local air-conditioning by using a GPS portable terminal or the like.

(F)

In the air-conditioning system 1 of the embodiment described above, the requesters carry the GPS portable terminals 91 to 96, and the communication unit 74 acquires data on the requesters' movement amounts and movement speeds through communication with the GPS portable terminals 91 to 96 via the orbiting satellite S. The PMVs of the requesters are calculated using this type of communication system.

Figure 22:
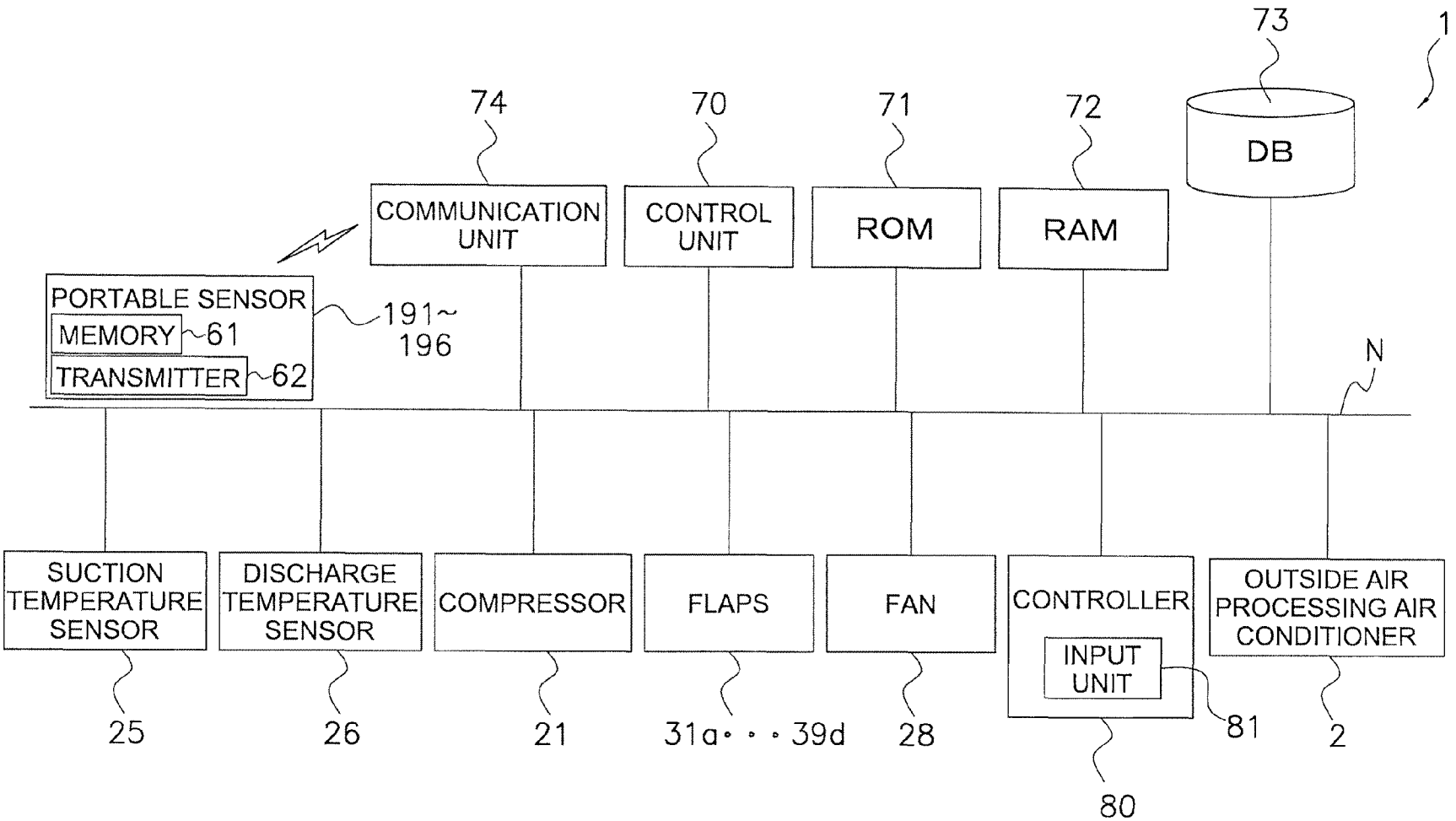
FIG. 22 is a block configuration diagram of the air-conditioning system according to Modification (F).

However, the present invention is not limited to this option alone, and a system may be used wherein each of the requesters carry portable sensors 191 to 196, as shown in FIG. 22, for example.

The portable sensors 191 to 196 can be, e.g., temperature sensors for measuring the requesters' body temperatures, external air temperature sensors for measuring the temperatures surrounding the requesters, external air humidity sensors for measuring the humidity surrounding the requesters, pedometers for measuring the number of steps taken by the requesters and the time intervals of the requesters' strides (the pace between steps), or the like. The portable sensors 191 to 196 each have a memory 61 which can store all data measured for each requester. Furthermore, the portable sensors 191 to 196 each have a transmitter 62 capable of wireless communication (or wired communication through a connection with predetermined communication lines) with the communication unit 74, and the data stored in each memory 61 can be transmitted to the communication unit 74. The memories 61 and transmitters 62 may either be built-in the portable sensors 191 to 196 or set up separate from but associated with each of the portable sensors 191 to 196.

The control unit 70 may be designed to presume, for example, that a higher requester body temperature corresponds to a higher metabolism rate; a higher air temperature surrounding the requester corresponds to a higher metabolism rate; a higher humidity surrounding the requester corresponds to a higher metabolism rate; a greater number of steps taken by the requester corresponds to a higher metabolism rate; and a shorter time interval between strides taken by the requester (a quicker pace) corresponds to a higher metabolism rate.

As one example, a system is herein described in which pedometers are used as the portable sensors 191 to 196 and are carried by requesters moving around outdoors. The pedometers can store the number of steps taken by the requesters outdoors, the time intervals between strides taken by the requesters (the pace between steps), i.e., the tempo, and other record data in the memories 61. The transmitters 62 of the pedometers can transmit the step number data, the tempo data, and other record data stored in the memories 61 to the communication unit 74 through wireless communication (or wired communication through a connection with predetermined communication lines) with the communication unit 74. When a requester has returned to the room R, for example, the record data stored in the memory 61 for the requester up until the time the requester entered the room R is transmitted from the transmitter 62 to the communication unit 74, whereby the control unit 70 can calculate a metabolism rate equivalent to the amount of heat stored in the requester's body. Using this metabolism rate, the control unit 70 can thereby incorporate a met value corresponding to the requester's seated work, the met value being read and obtained from the database 73, and the control unit 70 can calculate a metabolism rate reflecting seated work. The subsequent local air-conditioning control is identical to that of the embodiment described above.

The portable sensors 191 to 196 carried by the requesters are not limited to pedometers, and may be, for example, wearable sensors. Possible examples of wearable sensors include wristwatches, shoes, and other items worn by the requesters. Examples of such wearable sensors include wristwatches, shoes, or the like housing thermometers, pulse monitors, or the like, wherein the memories 61 and transmitters 62 are housed in the sensors in the same manner as described above.

The configuration and mode of control can otherwise be identical to the embodiment described above.

(G)

In the air-conditioning system 1 of the embodiment described above, the requester's PMV is calculated based on data on the movement amount and movement speed of the requester obtained through communication between the GPS portable terminals 91 to 96 and communication unit 74 via the orbiting satellite S.

Figure 23:
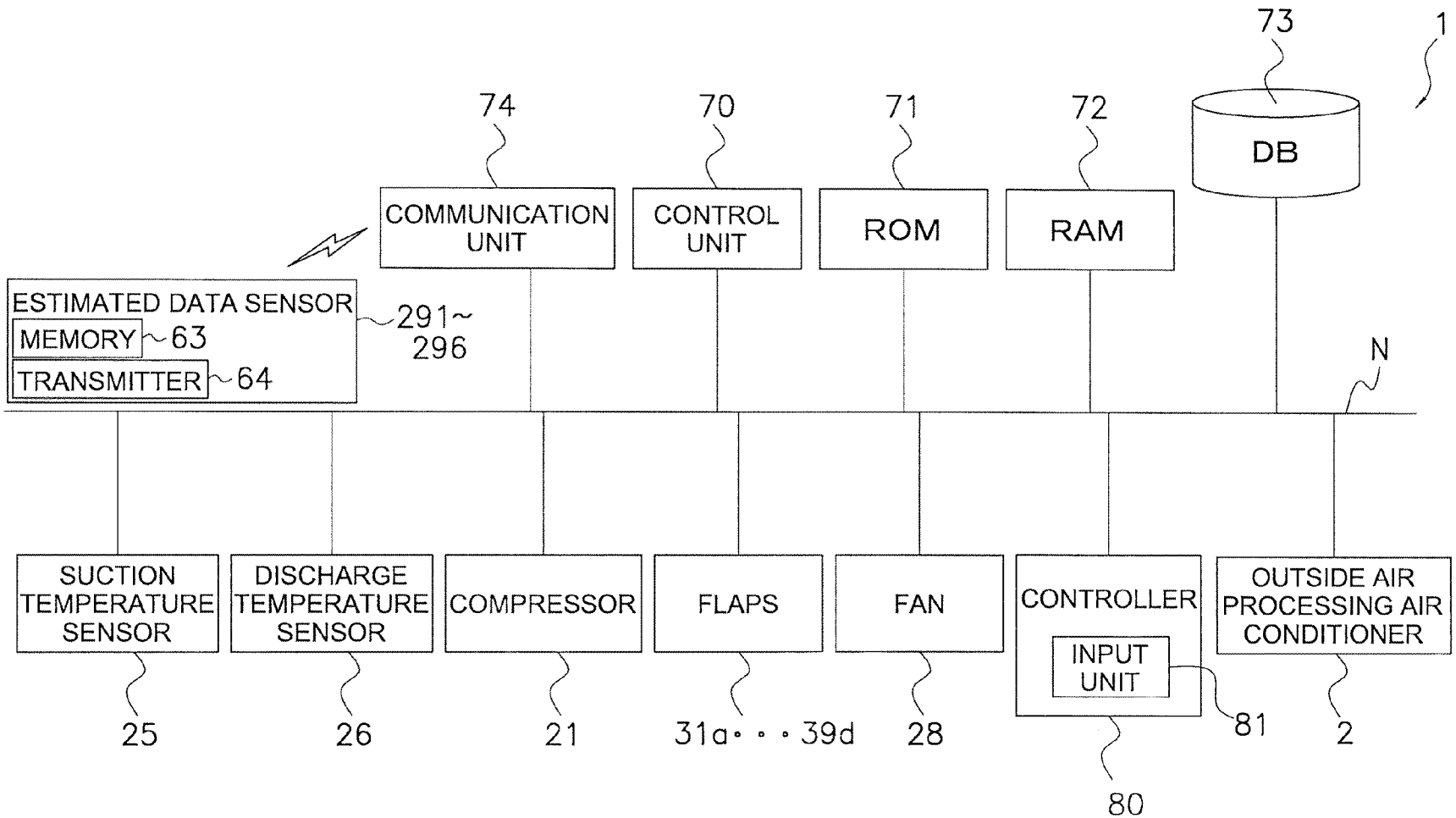
FIG. 23 is a block configuration diagram of the air-conditioning system according to Modification (G).

However, the present invention is not limited to this option alone, and another possible example instead of a system including GPS portable terminals 91 to 96 and an orbiting satellite S is a system wherein each of the users located in the room R carry estimated data sensors 291 to 296, as shown in FIG. 23.

The estimated data sensors 291 to 296 herein can be, e.g., temperature sensors for measuring the body temperatures of the requesters, the neighbors, and other users located in the room R; user-proximity indoor temperature sensors for measuring the indoor temperature surrounding the users; user-proximity humidity sensors for measuring the humidity surrounding the users; neighbor detection sensors for measuring the number of other users located in a range within a predetermined distance from the users; thermal radiation quantity sensors for measuring the quantity of heat radiated to the users from the wall surfaces or the like; pulse sensors for measuring the pulses of the users; respiration sensors for measuring the respiratory rates or respiratory tempos of the users; and other sensors. These estimated data sensors 291 to 296 each have a memory 63 capable of storing all measured data. Furthermore, the estimated data sensors 291 to 296 each have a transmitter 64 capable of wireless communication (or wired communication through a connection with predetermined communication lines) with the communication unit 74, and the data stored in each memory 63 can be transmitted to the communication unit 74. The memories 63 and transmitters 64 may either be built in the estimated data sensors 291 to 296 or set up separate from but associated with each of the estimated data sensors 291 to 296. RFID communication, wireless LAN communication, or another type of communication, for example can be used as the close-range wireless communication between the transmitters 64 and the communication unit 74. The control unit 70 can thereby calculate the metabolism rate for each requester on the basis of the values detected by the estimated data sensors 291 to 296.

A possible example of a neighbor detection sensor is a sensor wherein infrared strength or the like equivalent to body temperature emitted by the human body is measured using a pyroelectric infrared sensor or the like, the distance to the next human body is measured by an ultrasonic sensor, and the position of the other person is percived based on these two pieces of measured data.

The estimated data sensors 291 to 296 may be designed to be held not only by the requesters but also by the neighbors, whereby the sensors can detect the neighbors' body temperatures, the surrounding temperature, the surrounding humidity, thermal radiation quantity, the number of neighbors, and other data. In this case, the control unit 70 can calculate the neighbors' PMVs in the same manner in which it calculates the requester's PMV, and it is possible to determine whether or not the neighbors are made uncomfortable by the local air-conditioning control for the requester.

Thereby, even in a case of local air-conditioning control targeted at a requester merely located within the room R, rather than local air-conditioning control focusing on the metabolism rate of a requester coming into the room after being outdoors as in the embodiment described above, it is possible to perform local air-conditioning control reflecting the PMV of a requester in a state of possible discomfort resulting from changes in the surrounding environment. In this case, it is also possible to reduce the danger that neighbors located around the requester will experience discomfort from the local air-conditioning control for the requester.

It is also possible, e.g., to perform local air-conditioning control targeted at a requester whose PMV has become undesirable due to merely moving within the room R, a requester fallen into a state of discomfort due to sitting in a position exposed to the afternoon sun in the layout of the room R and being exposed to the afternoon sun, a requester fallen into a state of discomfort due to people gathering nearby and the number of neighbors increasing, a requester fallen into a state of discomfort due to changes in the set temperature of the indoor unit B, or another type of requester.

Figure 24:
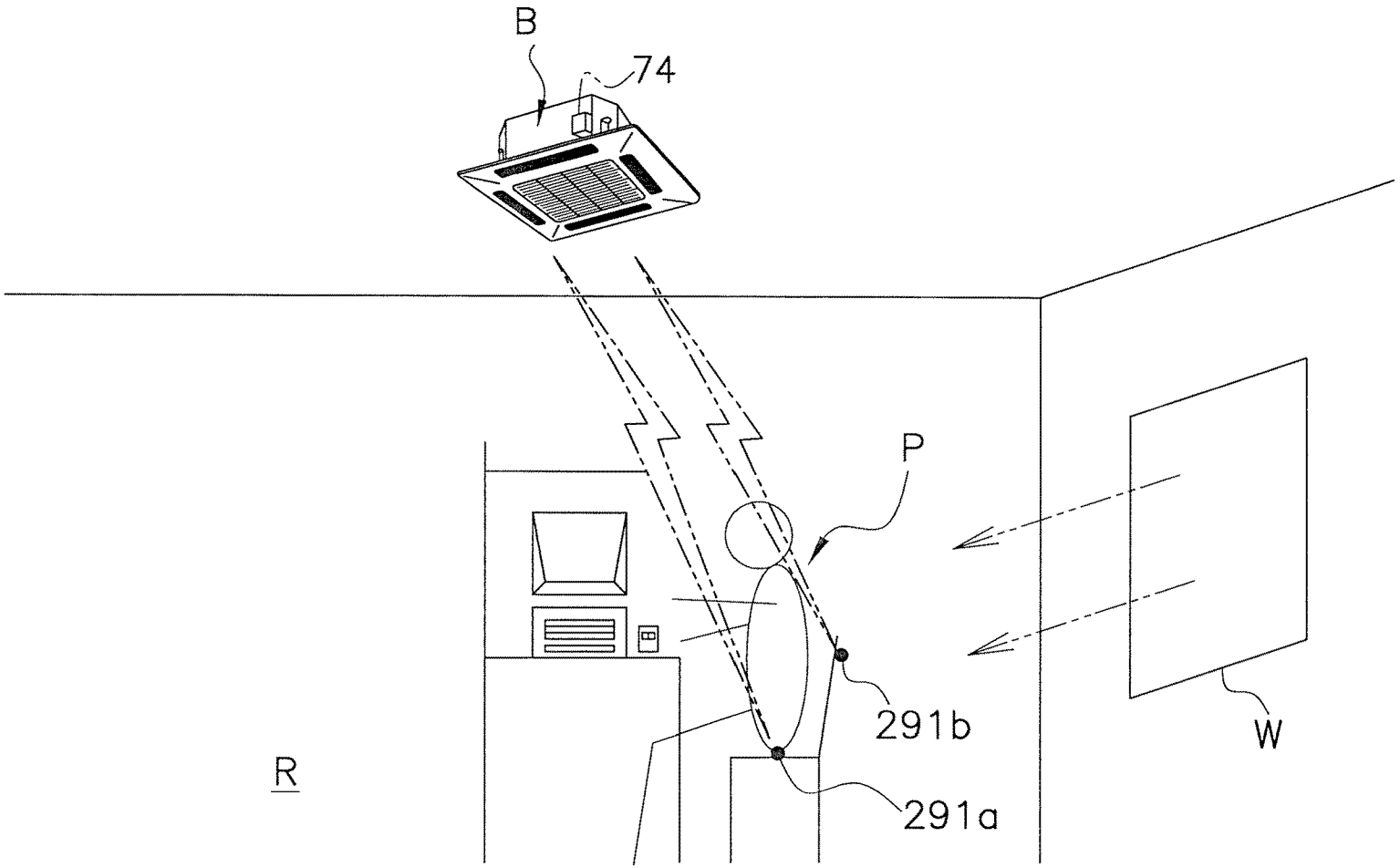
FIG. 24 is a conceptual drawing showing radiation toward the user according to Modification (G).

A system is described in FIG. 24 as an example in which a seat sensor 291*a* and a radiation sensor 291*b* are used as the estimated data sensors 291 to 296. The seat sensor 291*a* herein is provided on the seat of the chair so as to be capable of detecting the body temperature of the user P when the user P is sitting. The seat sensor 291*a* stores body temperature data for the user P in the memory 63, and the body temperature data for the user P is transmitted via the transmitter 64 to the communication unit 74 of the indoor unit B. The radiation sensor 291*b* is provided at a position on the chair separated from the position where the user P is sitting so as to not likely be affected by the body temperature of the user P, and also so as to be capable of detecting heat radiated from a window W or the like in the room R. The radiation sensor 291*b* measures the quantity of heat radiated from the window W, stores this data in the memory 63, and transmits the data on the radiation heat quantity to the communication unit 74 of the indoor unit B via the transmitter 64. Thus, it is possible to preceive changes in the environment surrounding the user P, and to reflect these changes in the local air-conditioning control by the control unit 70.

Other configurations and modes of control can be identical to those of the embodiment described above. Specifically, when numerical values have entered a predetermined range indicating that the requester has a comfortable PMV due to local air-conditioning control, the control unit 70 may perform a control for reducing or stopping local air-conditioning control in order to conserve energy. Furthermore, in cases in which a plurality of requesters are adjacent to each other in positions within a predetermined distance, local air-conditioning control may be performed respectively so that neighbors of a requester (a first) excluding another requester (a second) do not have uncomfortable PMVs by local air-conditioning control for the requester (the first), and also so that neighbors of the other requester (the second) excluding the requester (the first) do not have uncomfortable PMVs by local air-conditioning control for the other requester (the second).

INDUSTRIAL APPLICABILITY

According to the present invention, the comfort of the requester can be improved while any hindrance to the comfort of neighbors is minimized, and the present invention is therefore particularly useful when applied to an air-conditioning system for air-conditioning a space in which a plurality of users are present.

What is claimed is:

1. An air-conditioning system for supplying conditioned air to a plurality of users located in a target space, the air-conditioning system comprising:

an air-conditioning unit switchable between local air-conditioning and overall air-conditioning, with airflows being directed into part of the target space during local air-conditioning and airflows being directed throughout the entire target space during overall air-conditioning;

a state quantity data acquisition unit configured to acquire state quantity data of a requester moving in or into the target space; and a control unit configured to calculate a comfort assessment value for the requestor and a comfort assessment value for a neighbor of the requestor in order to assess a predetermined range as being comfortable to the requester and the neighbor, the comfort assessment values being calculated based on at least the data acquired by the state quantity data acquisition unit and an operating state of the air-conditioning unit, and to control the air-conditioning unit such that the local air-conditioning for the requester is performed to an extent whereby the comfort assessment value of the neighbor is kept in the predetermined range, and the comfort assessment value of the requester is within the predetermined range.

2. The air-conditioning system according to claim 1, wherein the control unit is further configured to control the air-conditioning unit in order to derate the level of local air-conditioning when the comfort assessment value of the requester has reached the predetermined range.

3. The air-conditioning system according to claim 1, wherein the state quantity data acquisition unit has a mobile communication terminal configured to be carried by the requester, and the mobile communication terminal is configured to acquire position data until the requester moves into the target space, and to acquire position data of any one of a GPS, a wireless LAN base station, and a ubiquitous sensor network.

4. The air-conditioning system according to claim 3, wherein the control unit is further configured to control the air-conditioning unit such that local air-conditioning for a first requester is performed to an extent whereby the comfort assessment values of neighbors of the first requester excluding a second requester are kept within the predetermined range and such that the comfort assessment value of the first requester is within the predetermined range when the control unit has determined based on data acquired by the state quantity data acquisition unit that the first requester and the second requester are adjacent to each other.

5. The air-conditioning system according to claim 3, wherein the air-conditioning unit has an air-blowing fan and a discharge temperature sensor; and the control unit is further configured to calculate the comfort assessment values of the requester and the neighbor based on at least the movement data records, local air-conditioning airflow rates determined from rotational speeds of the air-blowing fan, and airflow temperatures determined from the discharge temperature sensor.

6. The air-conditioning system according to claim 3, wherein the air-conditioning unit has an air-blowing fan and a discharge temperature sensor; and the control unit is further configured to calculate the comfort assessment value of the neighbor based on at least local air-conditioning airflow rates determined from rotational speeds of the air-blowing fan and airflow temperatures determined from the discharge temperature sensor.

7. The air-conditioning system according to any of claim 1, further comprising an outside air processing unit configured to introduce outside air into the target space after having its temperature adjusted, wherein the control unit is further configured to control an extent of temperature adjustment in the outside air processing unit in accordance with a set temperature of the target space and the level of local air-conditioning of the air-conditioning unit.

8. The air-conditioning system according to claim 7, further comprising a target space temperature sensor configured to detect a temperature of the target space; wherein the control unit is further configured to control an extent of temperature adjustment in the outside air processing unit while forcibly causing the local air-conditioning of the air-conditioning unit to be continued, even in cases in which the temperature detected by the target space temperature sensor has reached the set temperature.

9. The air-conditioning system according to claim 1, wherein the state quantity data acquisition unit has a movement data acquisition unit configured to acquire data in order to estimate state quantities when the requester has moved into the target space.

10. An air-conditioning system for supplying conditioned air to a plurality of users located in a target space, the air-conditioning system comprising:

an air-conditioning unit switchable between local air-conditioning and overall air-conditioning, with airflows being directed into part of the target space during local air-conditioning and airflows being directed throughout the entire target space during overall air-conditioning;

an estimated quantity data acquisition unit configured to acquire data in order to estimate state quantities of a requester located in the target space; and a control unit configured to calculate a comfort assessment value for the requestor and a comfort assessment value for a neighbor of the requestor in order to assess a predetermined range as being comfortable, the comfort assessment value for the requester being calculated based on the basis of at least state quantities of the requester estimated using the data acquired by the estimated quantity data acquisition unit and an operating state of the air-conditioning unit, and the comfort assessment value for the neighbor being calculated based on at least the operating state of the air-conditioning unit, and to control the air-conditioning unit such that the local air-conditioning for the requester is performed to an extent whereby the comfort assessment value of the neighbor is maintained in the predetermined range and the comfort assessment value of the requester is within the predetermined range.

11. The air-conditioning system according to claim 10, wherein the estimated quantity data acquisition unit is further configured to acquire data in order to estimate state quantities of the neighbor; and the control unit is further configured to calculate the comfort assessment value of the neighbor based on at least the state quantities of the neighbor estimated using the data acquired by the estimated quantity data acquisition unit and the operating state of the air-conditioning unit.

12. The air-conditioning system according to claim 10, wherein the estimated quantity data acquisition unit has an environment sensor configured to detect data pertaining to location of a user, the data being any one of radiation quantity, temperature, humidity, and number of neighbors.

13. The air-conditioning system according to claim 10, wherein the control unit is further configured to control the air-conditioning unit in order to reduce the level of local air-conditioning when the comfort assessment value of the requester has reached the predetermined range.

14. The air-conditioning system according to claim 13, wherein the control unit is further configured to control the air-conditioning unit such that local air-conditioning for a first requester is performed to an extent whereby the comfort assessment values of neighbors of the first requester excluding a second requester are kept within the predetermined range and such that the comfort assessment value of the first requester is within the predetermined range when the control unit has determined based on data acquired by the estimated quantity data acquisition unit that the first requester and the second requester are adjacent to each other.

* * * * *